US008827387B2

(12) United States Patent
Grela

(10) Patent No.: US 8,827,387 B2
(45) Date of Patent: Sep. 9, 2014

(54) SIDE CABINET AND HUTCH SYSTEM

(71) Applicant: Larry Mitchell Grela, Plainfield, IL (US)

(72) Inventor: Larry Mitchell Grela, Plainfield, IL (US)

( * ) Notice: Subject to any disclaimer, the term of this patent is extended or adjusted under 35 U.S.C. 154(b) by 0 days.

(21) Appl. No.: 13/573,740

(22) Filed: Oct. 4, 2012

(65) Prior Publication Data

US 2014/0097731 A1 Apr. 10, 2014

Related U.S. Application Data

(63) Continuation of application No. 12/804,161, filed on Jul. 14, 2010, now abandoned, which is a continuation of application No. 11/975,114, filed on Oct. 17, 2007, now abandoned.

(51) Int. Cl.
*A47B 88/00* (2006.01)

(52) U.S. Cl.
USPC ..... 312/323

(58) Field of Classification Search
USPC ..... 312/348.4, 334.11, 408, 263, 264, 312/223.3, 223.6, 334.7, 334.23, 322, 323
See application file for complete search history.

(56) References Cited

U.S. PATENT DOCUMENTS

| | | | | |
|---|---|---|---|---|
| 1,352,002 | A * | 9/1920 | Jones | 312/348.2 |
| 1,504,523 | A * | 8/1924 | Sherer | 108/102 |
| 1,987,822 | A | 1/1935 | Gregory | |
| 2,286,427 | A | 6/1942 | Levensten | |
| 2,525,208 | A | 9/1946 | Clink | |
| 3,520,583 | A | 7/1970 | Query for date and name | |
| 3,810,430 | A * | 5/1974 | Siegal | 108/147.16 |
| 3,818,179 | A * | 6/1974 | Mase | 219/267 |
| 3,848,942 | A | 11/1974 | Fanini | |
| 3,954,202 | A | 5/1976 | Petrick | |
| 4,058,210 | A | 11/1977 | Mitchell | |
| 4,108,514 | A | 8/1978 | Zimmerman | |
| 4,211,455 | A | 7/1980 | Tedrow | |
| 4,266,835 | A | 5/1981 | Schmidt | |
| 4,303,158 | A | 12/1981 | Perkins | |
| 4,591,214 | A * | 5/1986 | Reuter et al. | 312/110 |
| 5,399,010 | A * | 3/1995 | McClung et al. | 312/334.1 |
| 5,917,694 | A * | 6/1999 | Denny | 361/643 |
| 5,927,838 | A | 7/1999 | Hellman | |
| 5,951,129 | A | 9/1999 | Stein | |
| 6,422,386 | B1 | 7/2002 | Wiese et al. | |
| 729,808 | A1 | 11/2007 | Huguet | |
| 7,296,808 | B2 | 11/2007 | Huguet | |
| D574,628 | S | 8/2008 | Grela | |
| 7,510,078 | B2 | 3/2009 | Schmidt et al. | |
| 7,784,887 | B2 | 8/2010 | Grela et al. | |
| D636,615 | S | 4/2011 | Grela | |
| D649,377 | S | 11/2011 | Manalang et al. | |
| 8,056,995 | B2 | 11/2011 | Grela et al. | |
| 8,157,337 | B2 | 4/2012 | Manalang et al. | |

(Continued)

OTHER PUBLICATIONS

International Search Report for PCT Application No. PCT US2010/001732, Aug. 5, 2010.

(Continued)

*Primary Examiner* — Matthew Ing
(74) *Attorney, Agent, or Firm* — John G. Chupa

(57) ABSTRACT

A side cabinet and hutch system 10 comprising a hutch assembly 100 and a side cabinet assembly 500 and which is adapted to allow material to be easily and securely stored and retrieved and which is aesthetically pleasing and structurally sound.

1 Claim, 18 Drawing Sheets

(56) References Cited

U.S. PATENT DOCUMENTS

| | | | | |
|---|---|---|---|---|
| D678,694 | S | 3/2013 | Grela | |
| 2004/0239217 | A1* | 12/2004 | Patel | 312/323 |
| 2005/0204646 | A1 | 9/2005 | Tupper et al. | |
| 2007/0170826 | A1* | 7/2007 | Tsao | 312/223.3 |
| 2009/0102337 | A1* | 4/2009 | Grela | 312/294 |
| 2010/0072716 | A1 | 3/2010 | Grela | |
| 2010/0276317 | A1 | 11/2010 | Grela et al. | |
| 2010/0282629 | A1* | 11/2010 | Grela | 206/372 |
| 2010/0314978 | A1 | 12/2010 | Managlang et al. | |

OTHER PUBLICATIONS

Matco Tools Catalog at least as early as Feb. 6, 2009.
United States Trademark Registration No. 3,930,484, Mar. 15, 2011.
Matco Tools Catalog at least as early as Jan. 1, 1996.

* cited by examiner

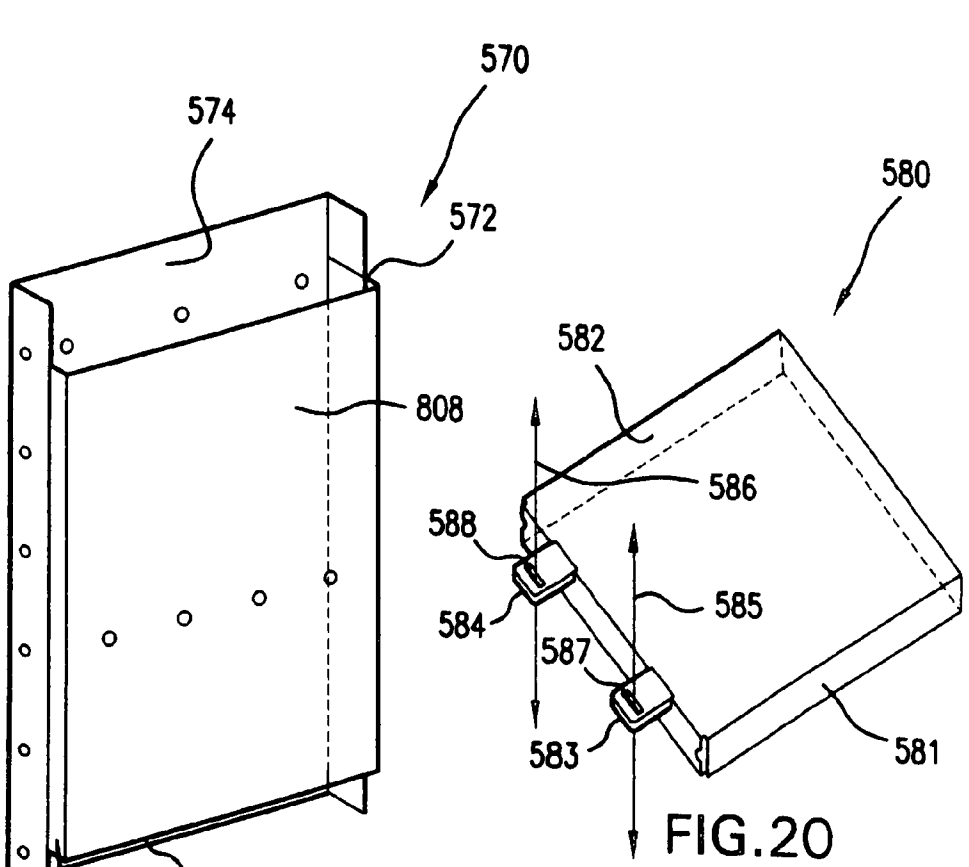
FIG.20
FIG.19
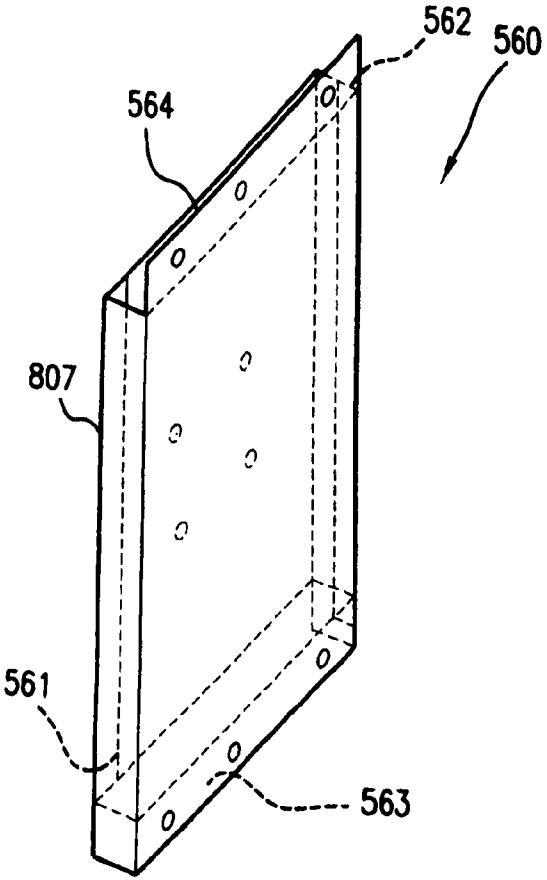
FIG.18

SIDE CABINET AND HUTCH SYSTEM

This Application is a continuation of U.S. patent application Ser. No. 12/804,161, which was filed on Jul. 14, 2010 and which was a continuation of U.S. patent application Ser. No. 11/975,114, which was filed on Oct. 17, 2007 and which is now abandoned. Priority is claimed from U.S. application Ser. Nos. 12/804,161 and 11/975,114.

FIELD OF THE INVENTION

The present invention generally relates to a side cabinet and hutch system and acre particularly to a side cabinet assembly and a hutch assembly, which are both aesthetically pleasing, which are sturdy, which are able to be easily locked, which are highly functional, and which allows items to be efficiently stored and accessed. The present invention also provides a method for effectively, securely, and selectively storing and locking items.

BACKGROUND OF THE INVENTION

Side cabinet assemblies and hutch assemblies are used either individually or together as a system with existing toolbox assemblies to selectively store tools, such as automotive repair type tools, and other materials. While these assemblies do allow such tools and other materials to be stored and selectively retrieved, they suffer from several drawbacks.

By way of example and without limitation, many of these side cabinet and hutch assemblies as not aesthetically pleasing and are not very sturdy. For example, many of these side cabinet assemblies or hutch assemblies have unsightly weld type connections formed on several or all of the surfaces of the body and such connections undesirably disrupt the overall appearance of the assembly, and many of these side cabinet and hutch assemblies bend or bow over time, due to the weight associated with the stored items and the fact that they are not structurally sturdy, and many of these assemblies even break.

Further, by way of example and without limitation, many of these side cabinet assemblies or hutch assemblies are not provided as stand-alone side cabinet or hutch assemblies for selectively coupling to and adding on to existing toolbox assemblies already in use by users and thus expanding the versatility and functionality of toolbox assemblies being utilized. Therefore, users are required to acquire additional toolbox assemblies with either a side cabinet or a hutch, increasing the costs associated with acquiring and using a side cabinet assembly or a hutch assembly.

Yet further, these prior and current hutch assemblies do not provide for a selectively adjustable shelf having a "built-in" radio, Universal Serial Bus ("USB") or Serial ports, and a power strip, and which provide added functionality to the hutch assembly as well as accommodating different storage strategies or techniques of various users of these hutch assemblies.

The present invention overcomes these and other drawbacks associated with current and prior hutch assemblies in a new and useful manner.

SUMMARY OF THE INVENTIONS

It is a first non-limiting object of the present invention to provide a side cabinet assembly which overcomes some or all of the previously delineated drawbacks and disadvantages of prior and current side cabinet assemblies, such as by way of example and without limitation, those which are delineated above.

It is a second non-limiting object of the present invention to provide a hutch assembly which overcomes some or all of the previously delineated drawbacks and disadvantages of prior and current hutch assemblies, such as by way of example and without limitation, those which are delineated above.

It is a third non-limiting object of the present invention to provide a side cabinet and hutch system which is sturdy, aesthetically pleasing, allows a wide range of storage strategies and items to be utilized and has enhanced functionality.

According to a first non-limiting aspect of the present invention, a hutch assembly is provided and includes a door comprising a reinforcement member coupled to said door with an adhesive, and which includes a generally C-shaped door handle member which is adapted to reflect ambient light in an aesthetically pleasing manner, thereby providing a hutch assembly which does not have any spot welds and which is aesthetically pleasing.

According to a second non-limiting aspect of the present invention, a selectively lockable hutch assembly is provided and which includes a door portion wherein said door comprising a plurality of locking guides; a plurality of first and second side panels; a plurality of locking members, wherein each of said plurality of locking members are deployed in a coextensive manner upon said door portion; a plurality of first and second track assemblies, wherein said plurality of first and second track assemblies are deployed in a linearly coextensive manner upon said plurality of side panels; a trolley member which comprises a plurality of first and second bearings and wherein said trolley member is coupled to said track assembly by said plurality of said first and said second bearings; a shelf having a plurality of slots and wherein said shelf is coupled to said plurality of side panels.

These and other features, aspects, and advantages associated with the present inventions will become apparent from a reading of the following detailed description of the preferred embodiment of the inventions, including the subjoined claims, and by reference to the following drawings.

BRIEF DESCRIPTION OF THE DRAWINGS

FIG. 18 is a perspective view of the right panel member of the side cabinet assembly which is shown in FIGS. 1, 16.

FIG. 19 is a perspective view of the left panel member of the side cabinet assembly which is shown in FIGS. 1, 16.

FIG. 20 is a perspective view of the bottom panel member of the side cabinet assembly which is shown in FIGS. 1, 16.

DETAILED DESCRIPTION OF THE PREFERRED EMBODIMENT OF THE INVENTIONS

Figure 1:
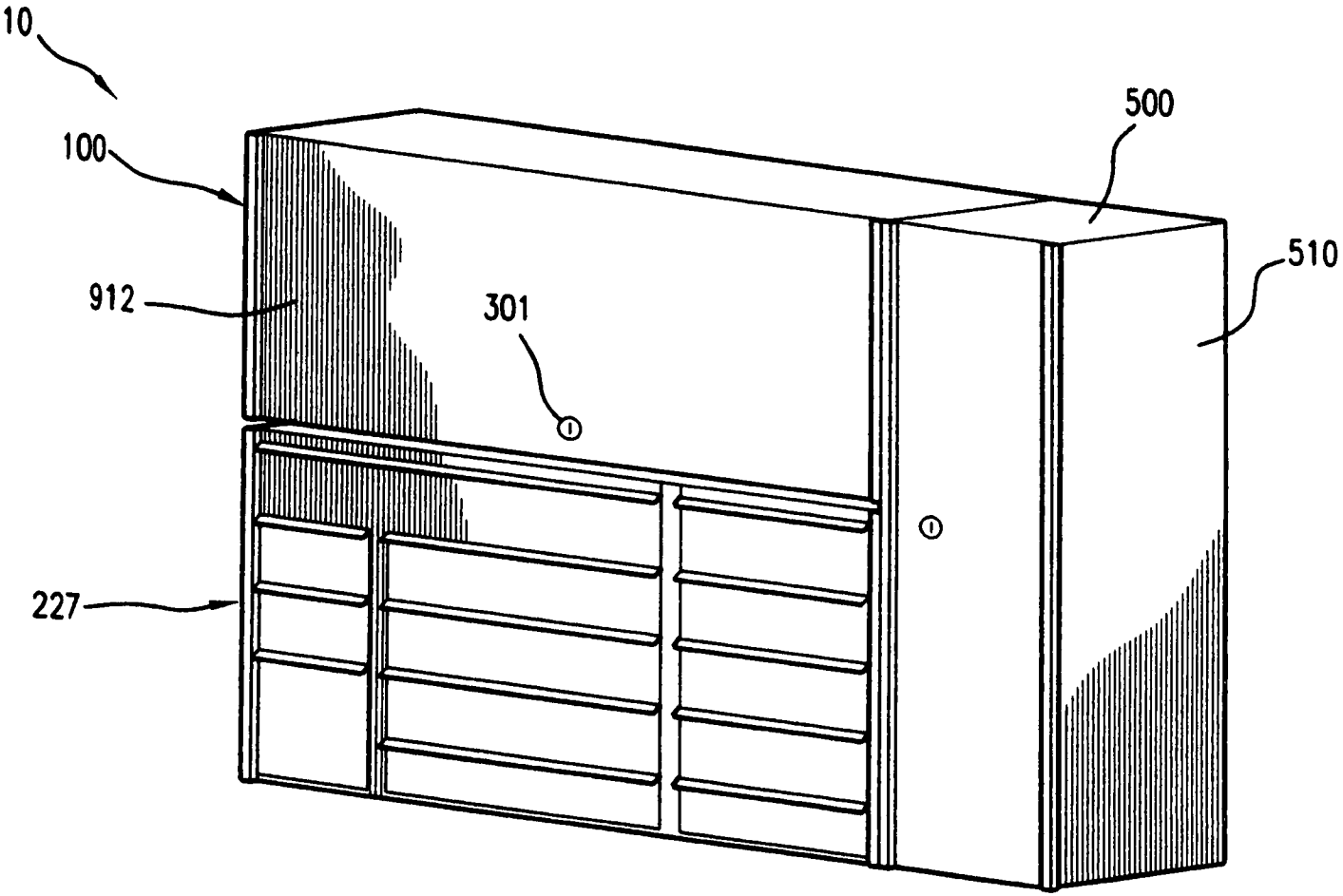
FIG. 1 is a perspective view of a side cabinet and hutch assembly which is made in accordance with the teachings of the preferred embodiment of the inventions.

Referring now to FIG. 1, there is shown a side cabinet and hutch system 10 which is made in accordance with the teachings of the preferred embodiment of the various invention and which is used for selectively and securely storing tools and/or implements.

Particularly, the side cabinet and hutch system 10 comprises a hutch assembly 100 and a side cabinet assembly 500 and each are selectively provided to attach to existing tool box assemblies, such as tool box assembly 227 to provide for more functionality to existing toolbox assemblies 227.

Particularly, the hutch assembly 100 includes a generally hollow body 912 which is selectively formed by a plurality of members which will be discussed below, and which is adapted, as is evident from the discussion below, to selectively and movably receive tools and/or other items and which allows these received tools and/or other items to be efficiently accessed and then later deposited into the hutch assembly for secure storage.

Figure 3:
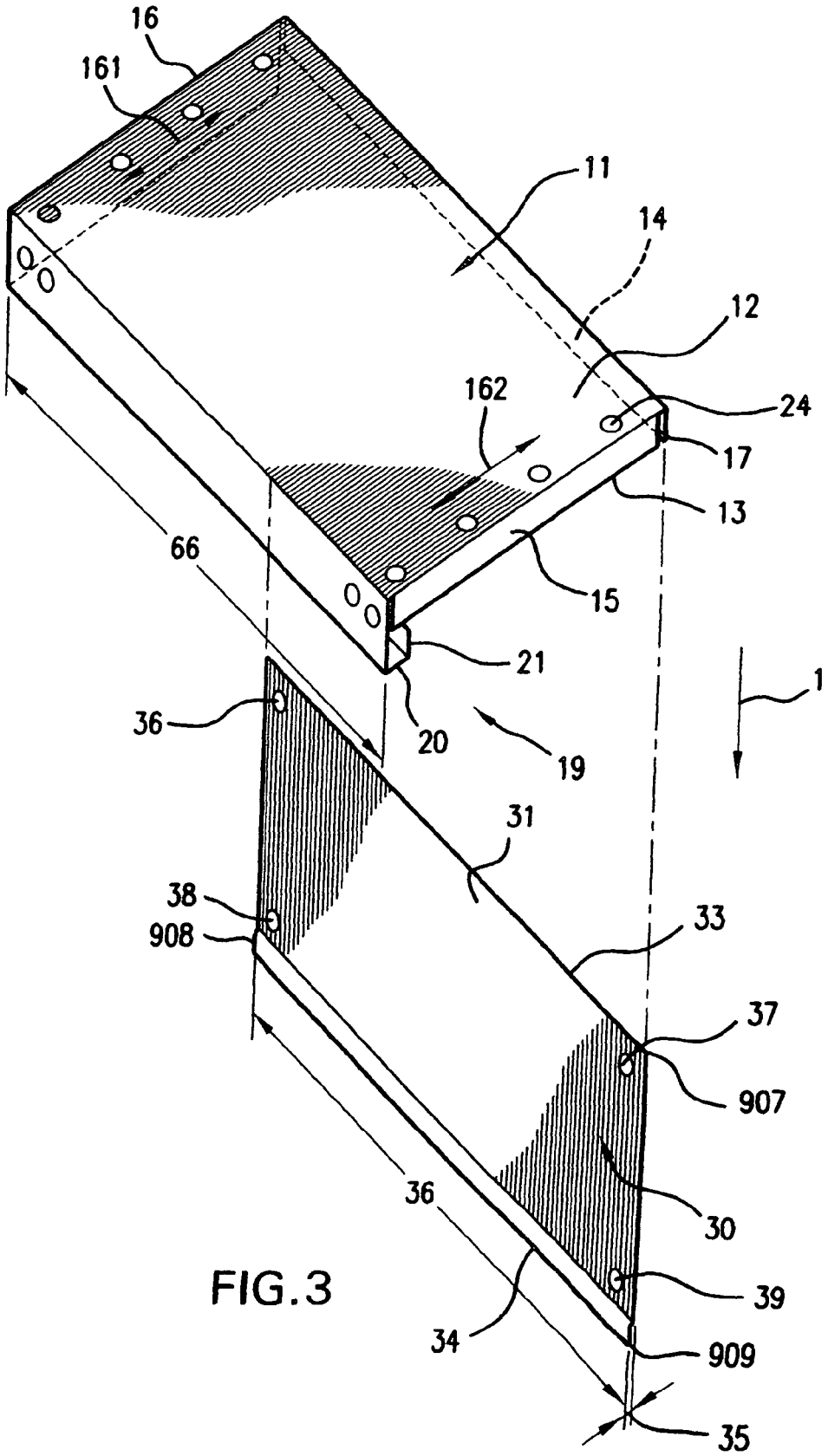
FIG. 3 is a perspective and unassembled view of a top panel member and a back panel member and which is shown in FIG. 2.

Referring now to FIG. 3, the hutch assembly 100 includes a stainless steel top panel or member 11 which is substantially planar and a back panel 30 which are coupled together. It should be appreciated that panels 11, 30, may, of course, be constructed from a variety of materials and nothing in this description limits the hutch assembly 100 to only one of several specific types of materials.

Particularly, top member 11 has a first generally planar surface 12, and an opposed and generally flat interior or bottom surface 13. The top member 11 further includes a generally planar edge 18, which is linearly coextensive to length 66 of surfaces 12, 13, and which orthogonally projects from the surface 13 in direction 1 (i.e., the edge 18 forms a right angle with surface 13) and edge 18 terminates into a generally "L-shape" planar portion 19. Portion 19 has a first planar member 20 which orthogonally projects from edge 18 and is linearly coextensive with edge 18, and member 20 terminates into portion 21. Portion 21 is orthogonal to portion 20 and is linearly coextensive to length 66 (i.e., portion 21 is generally parallel to edge 18). Top member also includes a generally planar edge 14 which is linearly coextensive with surfaces 12, 13 and which orthogonally projects from surface 13 in direction 1 (i.e., the edge 14 forms a right angle with surface 13), and which has an inside surface 23 which is coupled to edge 33 of panel 30, and which will be discussed below. Top member 11 also has a plurality of substantially identical planar side edges 15, 16, which orthogonally project from the surface 13 in direction 1 (edges 15, 16 form a right angle with surface 13). Further, top panel 11 has a groove 17 formed at the corner between edges 14, 15 and a substantially similar groove 22 formed at the corner between edges 14, 16 and grooves 17, 22 receives edge 33 of back panel and which will be described below.

Figure 6:
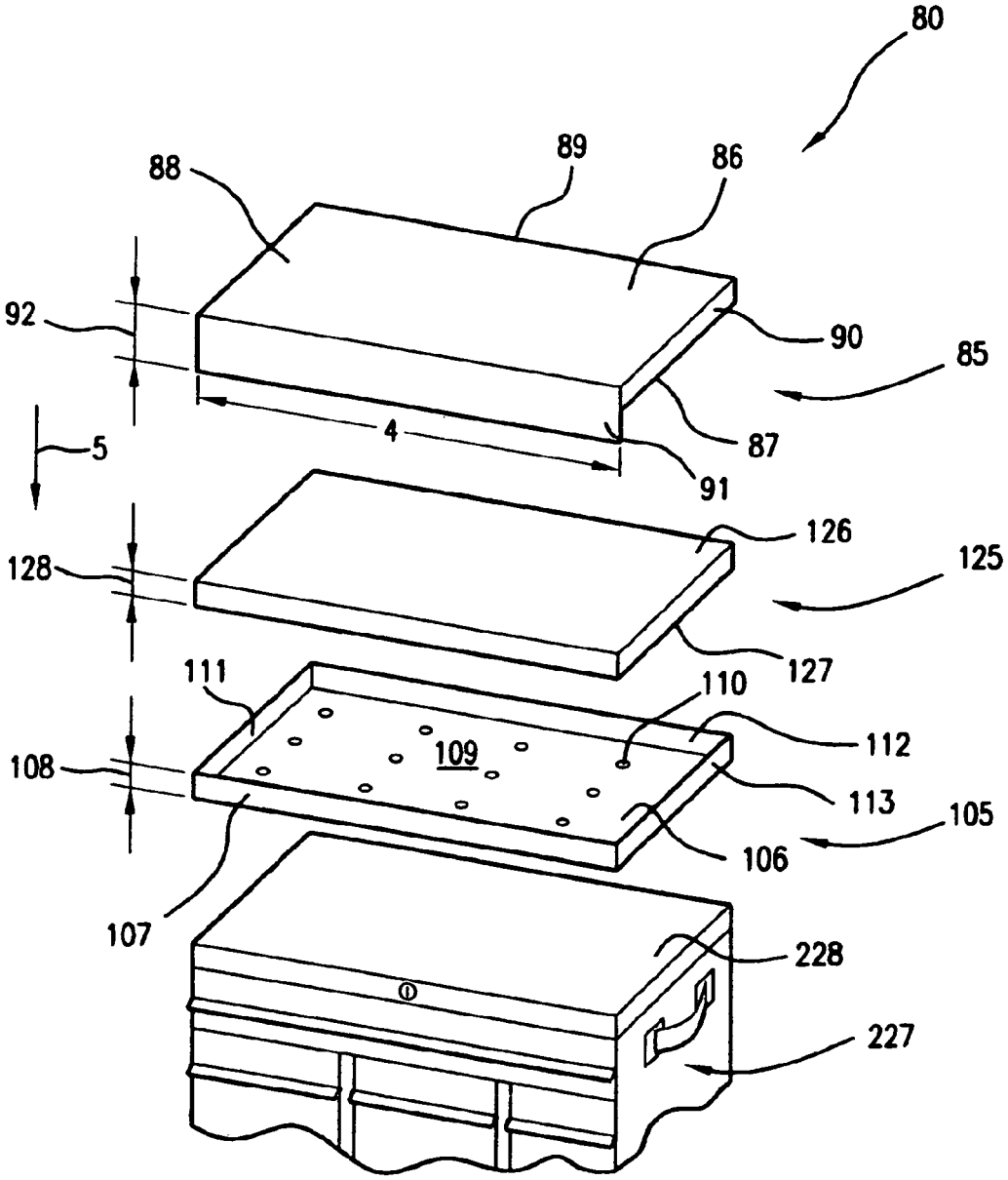
FIG. 6 is a perspective and unassembled view of the bottom panel in combination with various internal panels of the hutch assembly which is shown in FIGS. 1 and 2.
Figure 7:
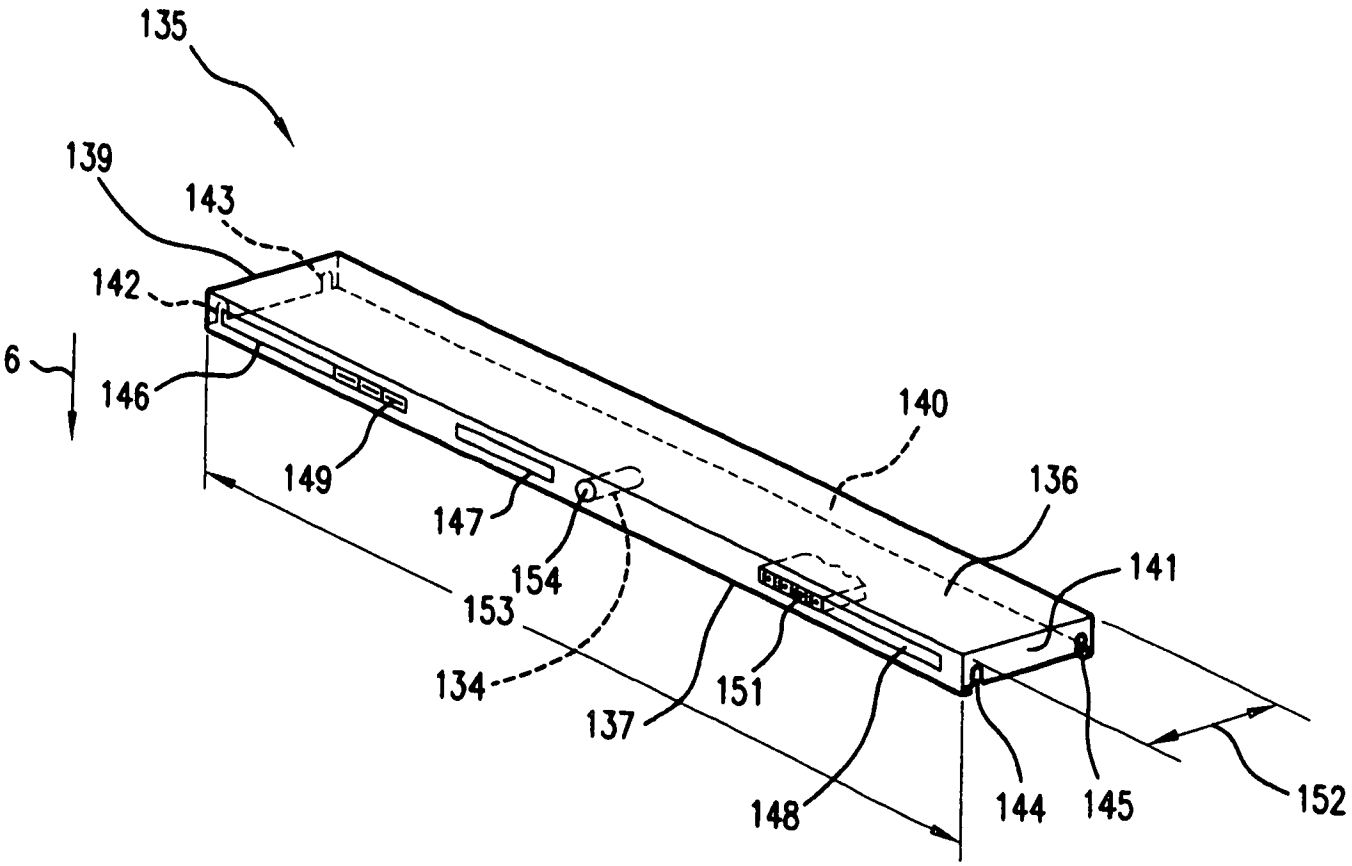
FIG. 7 is a perspective view of the hutch shelf which is shown in FIG. 2.

The hutch assembly 100 further includes a generally flat back panel 30 and which has a first interior surface 31 and an is opposed and generally flat exterior or outside surface 32. Back panel 30 has a first edge 33 which is coupled to top panel 11 at surface 23 of edge 14. Particularly, edge 33 of panel 30 resides within grooves 17, 22 of panel 11 while edge 33 is coupled to surface 23, and such coupling being linearly coextensive to length 36 of panel 30. Further, such coupling may be achieved by the use of a welded connection or substantially any other type of connection strategy or technique. Back panel 30 has a raised edge 34 having a height 35 which is linearly coextensive with length 36 of panel 30, and which is coupled to bottom support member 105 (as best seen in FIG. 6) at raised edge 34 of back panel 30. It should be appreciated that coupling of back panel 30 may be achieved by the use of a welded connection or substantially any other type of connection strategy or technique. It should further be appreciated that back panel 30 may include, in one non-limiting embodiment, a plurality of substantially similar and "preformed" holes 36, 37, 38, 39, which are formed at the corners 906, 907, 908, 909 respectively of panel 30, and which are used to selectively receive a power cord or other type of electrical connection so as to provide electrical power to a power strip panel, such as power strip panel 148 (as seen in FIG. 7), in a manner which is more fully described later in this description.

Figure 2:
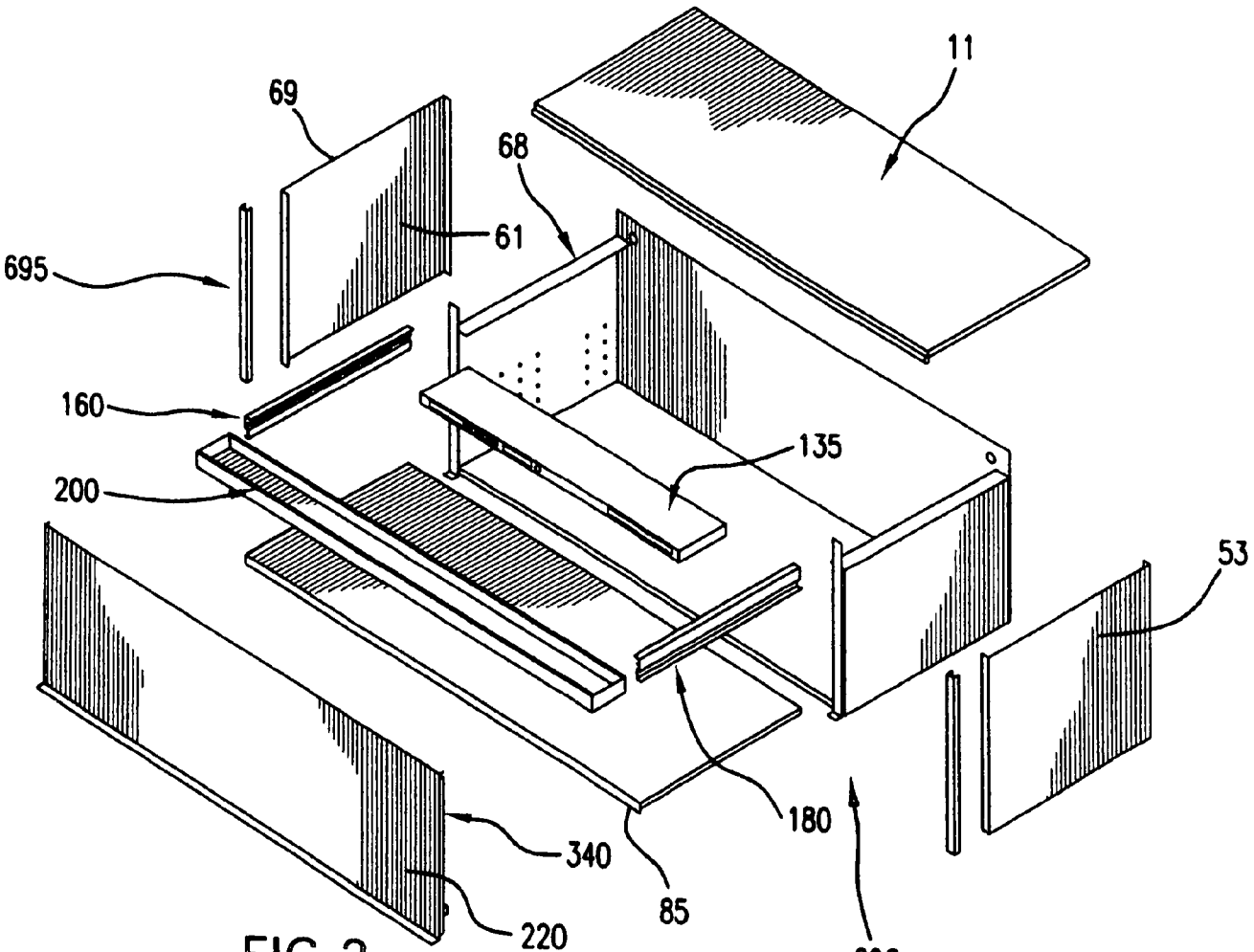
FIG. 2 is a partial perspective unassembled view of the hutch assembly which is shown in FIG. 1.

Yet further and as best seen in FIGS. 2 and 6, the hutch assembly 100 includes bottom panel assembly 80 which comprises a stainless steel bottom member 85, a bottom support member 105, both of which are substantially planar and which are configured to receive a substantially planar wood panel 125. Particularly, bottom support member 105 has a first generally planar surface 106 and an opposed and generally flat bottom surface 107 which is adapted, in one non-limiting embodiment, to be selectively coupled to a planar surface 228 of toolbox assembly 227, thereby providing hutch assembly 100, which can be selectively coupled to an existing be toolbox assembly, such as toolbox assembly 227, and thus expanding the versatility and functionality of toolbox assemblies, such as toolbox assembly 227. Additionally, surface 106 has a plurality of equally spaced and preformed apertures, such as aperture 110, which are used to receive a bolt, screw, rivets, or other type of fastener in order to couple member 105 to inner surface 127 of panel 125 and also to couple member 105 to surface 228 of toolbox assembly 227.

Yet further, bottom support member 105 includes a plurality of substantially similar edge 107, 112 which orthogonally project from surface 106 in direction 3 (i.e., edges 107, 112 form a right angle to surface 106). Member 105 also includes a plurality of substantially similar edges 111, 113 which orthogonally project from surface 106 in direction 3 and edges 107, 112 cooperate with edges 111, 112 to form a cavity or reception area 109 in which a substantially planar wood panel 125 resides (i.e., bottom surface 127 of wood panel 125 resides and is contained within cavity 109). Wood panel 125, in one non-limiting embodiment, has a thickness 128, which is greater than thickness 108 of member 105. Bottom support member 105 is coupled along edge 112 to edge 34 of back panel 30 (see FIG. 3) and member 105 is coupled along respective edges 111, 113 to side panels 40, 60 (FIG. 5, 6).

Also as seen in FIG. 6, hutch assembly 100 also includes a stainless steel bottom member 85 which has a generally planar top surface 86, and an opposed and generally flat bottom surface 87 which is adapted to be coupled to top surface 126 of wood panel 125, and this coupling may be achieved by the use of screws or substantially any other type of connection strategy or technique. Bottom member 85 has a plurality of substantially identical protruding and planar edges 87, 88, 89 and which are orthogonal to surface 86 in direction 5 (i.e., edges 87, 88, 89 form a right angle with surface 86). Further, the member 85 further includes a generally planar edge 91 which is linearly coextensive to surfaces 86, 87 along width 4 of top member 85 and which orthogonally projects from the surface 86 in direction 5 (i.e., edge 91 forms a right angle with surface 86). Edge 91 has a width 92 which, in one non-limiting embodiment, is at least the width 128 of wood panel 125 and edge 91 being formed to protrude below planar portion 125 when portion 85 is positioned to reside upon portion 125 and portions 85, 125 further residing within cavity 109 of portion 105. Portion 85, being coupled to bottom support member 105 provides an additional work area on surface 86 when hutch assembly 100 is unlatched while also serving as a storage area for tools and/or implements when hutch assembly 100 is latched by door assembly 220 which will be described below.

Figure 5:
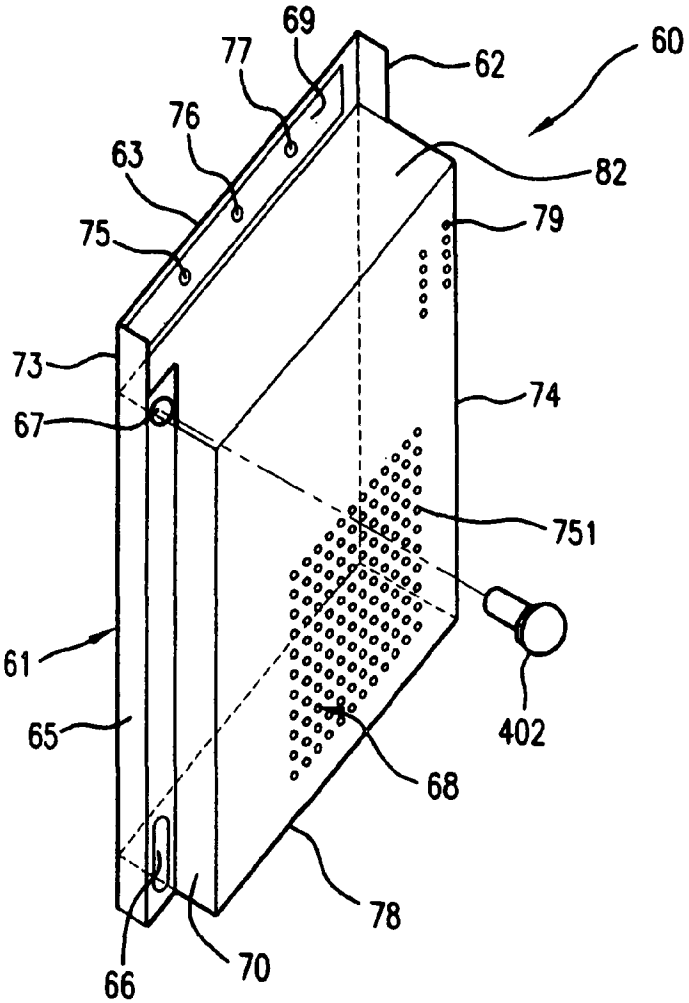
FIG. 5 is a perspective view of the left inner panel of the hutch assembly which is shown in FIGS. 1 and 2.
Figure 4:
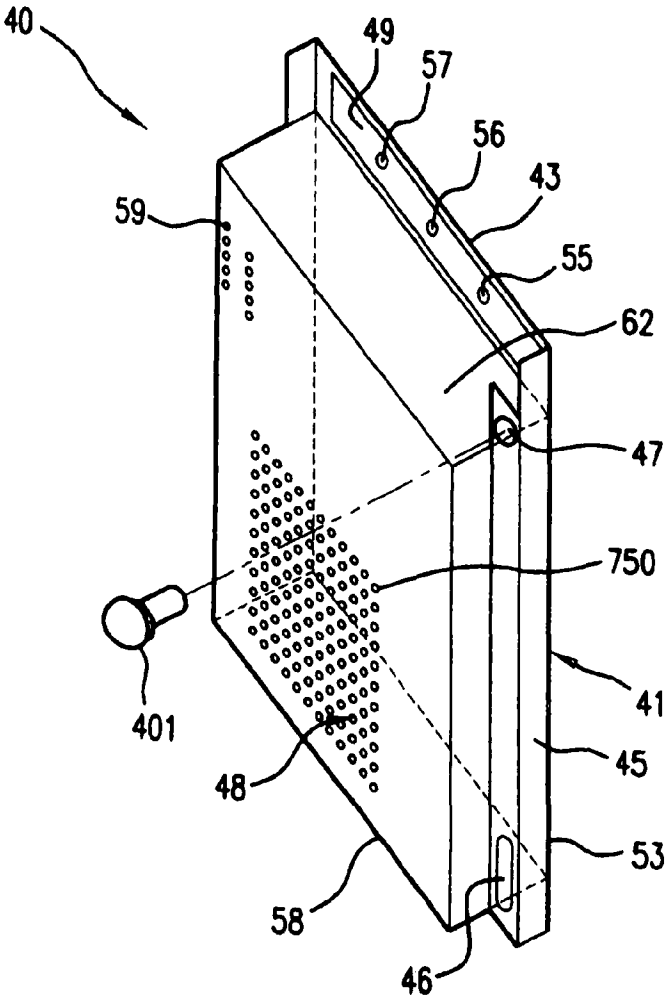
FIG. 4 is a perspective view of the right inner panel of the hutch assembly which is shown in FIGS. 1 and 2.

Further, as shown perhaps best in FIGS. 2, 4, and 5, the hutch assembly 100 includes a plurality of generally planar and substantially identical end panels 40, 60. Particularly, end panel 40 comprises a generally planar inner panel 48 and a generally planar outer panel 41 which is coupled to inner panel 48 along edges 50, 54. Also, outer panel 41 has a generally planar outer surface 53 and an opposed and generally flat interior surface 43. Surface 43 is also coupled to a reinforcement plate 49 which is linearly coextensive with edge 43 of outer panel and which has a plurality of substantially similar and identical preformed apertures 55, 56, 57 which protrude from surface 53 and which are adapted to receive bolts, screws, or other type of fastener to couple hutch assembly 100 to side cabinet assembly 500 and which will be described below. Inner panel 48 further has a plurality of substantially similar and equally spaced accessory holes, such as accessory hole 750, and which are adapted to receive hooks or other type of connection member and which are utilized to carry tools and/or implements. Inner panel 48 also has a plurality of substantially similar and equally spaced preformed apertures, such as aperture 59, and which receive a bolt or other type of connection member and which are adapted to receive an adjustable shelf 135 by selectively coupling shelf 135 to apertures, such as aperture 59.

Hutch assembly 100 also comprises an end panel 60 which comprises a generally planar inner panel 68 and a generally planar outer panel 61 which is coupled to inner panel 68 along edges 70, 74. Also, outer panel 61 has a generally planar outer surface 73 and an opposed and generally flat interior surface 63. Further, Surface 63 is coupled to reinforcement plate 69 and plate 69 is linearly coextensive with edge 63 of outer panel and which has a plurality of substantially similar and identical preformed holes 75, 76, 77 which protrudes from surface 73 and which are adapted to receive bolts, screws, or other type of fastener to couple hutch assembly 100 to side cabinet assembly 500 in an alternate configuration and which will be described below. Further, outer panel 41 has a slot 46 preformed in edge 45, and which is generally "rectangular", and which is adapted to receive lock bar guide 261 (which will be described in FIGS. 11, 13) while outer panel 61 has a substantially similar slot 66, which is generally "rectangular" shaped, and which is also adapted to receive lock bar guide 280 in order to selectively lock hutch assembly 100 (which will be described in FIGS. 11, 13). It should be appreciated that use of such multiple panels, such as panels 41, 48 increases the structural integrity and strength of the hutch assembly 100.

End panels 40, 60 are respectively coupled along respective edges 42, 62 to the outer surface 32 of back panel 30, and which are respectively coupled along respective edges 43, 63 to edges 15, 16 of top member 11 and which are respectively coupled along respective edges 58, 78 to bottom support member 105. In this manner, the members 11, 30, 40, 60, and 105 form a generally hollow body 912 (e.g. forming a cavity 130) into which various items may be selectively deposited for secure storage and then later retrieved for use. It should be appreciated that such coupling may be achieved by the use of a welded connection, by rivets, or by any other type of fastener methodology or strategy. It should be appreciated that panels 40, 60 may be powder coated and/or painted before being installed and that all other panels and components of the hutch assembly 100 may be similarly painted and/or powder coated before being installed, thereby reducing the effort needed to construct the hutch assembly 100 while providing a consistent finish and a pleasing overall aesthetic appearance.

Also as best seen in FIGS. 2, 7, within the formed cavity 130, there may be positioned a selectively adjustable inner shelf 135 which has a generally planar top surface 136 and an opposed and generally flat interior or bottom surface 137. The inner shelf 135 has a plurality of edges 138, 140 which are each linearly coextensive to length 153 and each edge 138, 140 orthogonally projects from the surface 136 forming a "L-shape" with the surface 137 (i.e., the edges 138, 140 form a right angle with surface 136). Further, edge 138 has a plurality of slots 146, 147, 148, 134, which are adapted to receive various electronic implements and which are selectively provided within edge 146 of hutch assembly 100. Particularly, slot 146 is preformed in edge 138 to receive a plurality of Universal Serial Bus ("USB") receptacles, such as receptacle 149, and in one non-limiting embodiment, a receptacle 149 commercially available from Cypress Industries® on website www.cypressindustries.com is provided. In one non-limiting embodiment, various other electronic assemblies, such as a speaker jack commercially available from TecNec® on website www.tecnec.com, and a "radio" commercially available from Kenwood on website www.crutchfield.com are provided. Further, slot 147 is preformed in edge 138 and selectively receives an electric switch, such as electric switch 150, and where switch 150 selectively turns "on" or "off" the source of electric power to shelf 135 while slot 148 selectively receives a "power strip" 151 (i.e., an electrical connection holding a plurality of electrical outlets for providing electrical power to various electric implements), and in one non-limiting embodiment, a power strip 151 commercially available from Brooks Power Systems® on website www.brookspower.com is provided. Also, slot 134 is provided to receive a 12 volt cigarette lighter receptacle, such as receptacle 154, and in one non-limiting embodiment, a receptacle 134 commercially available from Creative Energy Technologies® on website www.cetsolar-.com is utilized. It should be appreciated that nothing in this embodiment limits the items provided to the aforementioned items and in other non-limiting embodiment, other items may be provided in slots 146, 147, 148, 134, to provide hutch assembly 100 according to preferences of particular users of the hutch assembly 100.

Yet further, shelf 135 has a plurality of substantially similar edges 139, 141 which are linearly coextensive to width 152 and which orthogonally project from surface 136 in direction 6. Further edge 139 has a plurality of substantially similar slots 142, 143 which emanates and terminates in edge 139 in direction 6 and which couples edge 139 to panel member 68 of panel 60 utilizing preformed apertures 79, and this coupling may be made by screws, bolts, or any other type of strategy. Similarly, edge 141 has a plurality of substantially similar slots 144, 145 which are adapted to couple edge 139 to panel 68 at preformed apertures 79, and this coupling may be made by screws, bolts, or any other type of strategy. Thus, shelf 135 provides additional functionality and versatility to hutch assembly 100 and provides a user with a selectively adjustable shelf 135 containing a plurality of electronic assemblies, such as receptacle 149 which increases the functionality and utility of hutch assembly 100.

Figure 8:
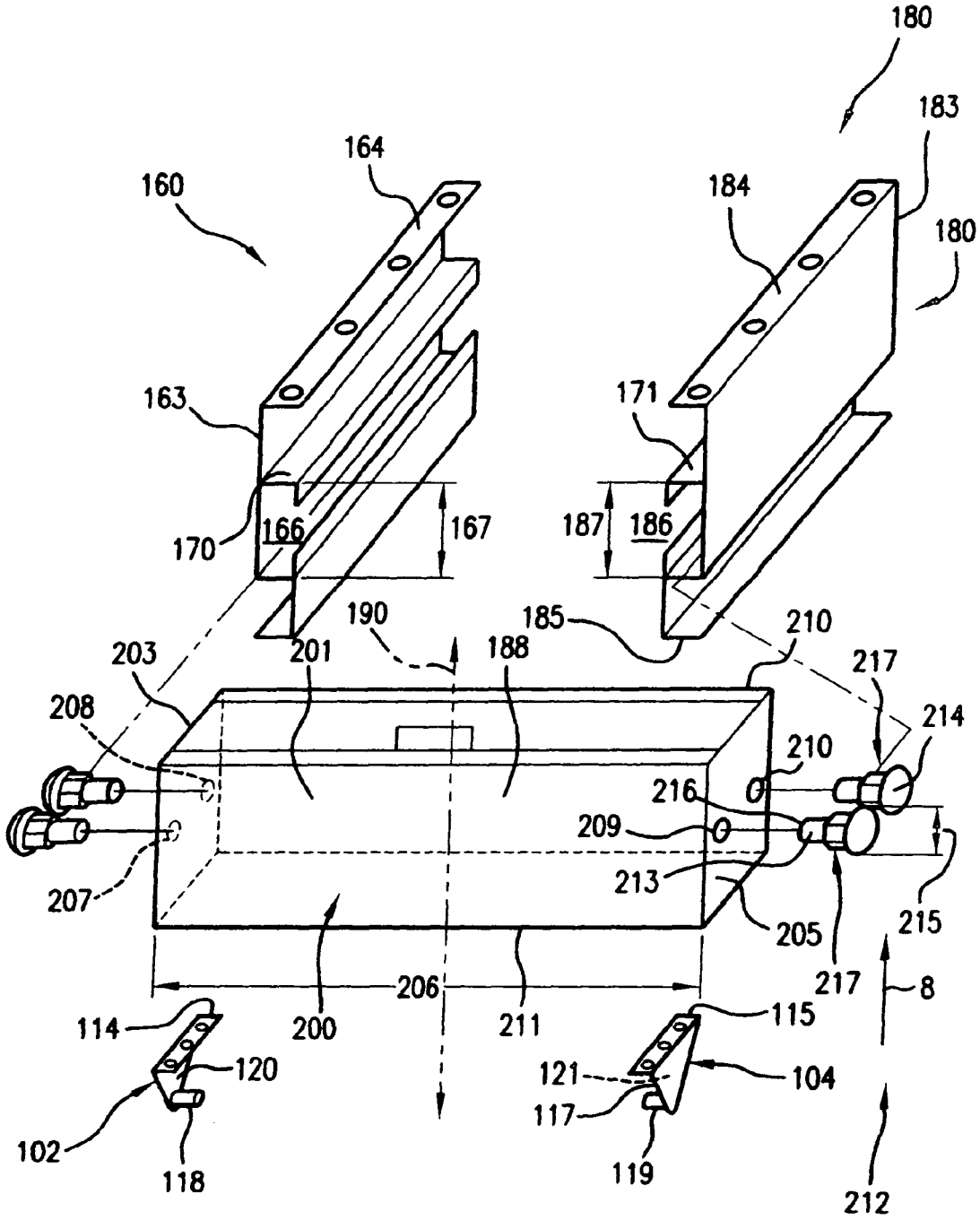
FIG. 8 is a perspective unassembled view of a track assembly which is shown in FIGS. 1 and 2.

Further, as is shown perhaps best in FIGS. 2, and 8, the hutch assembly 100 includes a plurality of substantially identical track assemblies, such as track assemblies 160, 180, and a trolley assembly 200. Each of these substantially identical track assemblies 160, 180, are deployed upon inside surface 13 of top panel member 11, upon the edge 62 of the inner panel 41 of panel 40, and upon edge 82 of the inner panel 62 of panel 60. That is, each of the track assemblies, such as assembly 160, 180 are attached to a panel 11, 42, 62 along a unique one of the respectively pre-formed line or axis, such as track assembly line 161 and are attached to a panel by the use of a bolt, rivet, or other fastener which is through substantially identical apertures, such as aperture 24 on top panel 11, which cooperatively form the line upon which the track assembly member resides.

Particularly, each of the substantially identical track assemblies, such as track assemblies 160, 180, respectively lies upon a unique axis or line, such as axes 161, 162 which are each parallel to the top surface member or portion 11. Track assemblies 160, 180 respectively include a first "C-shaped" receptacle portion 170, 171 which are coupled to a respective "S-shaped" second portion 163, 183, and this coupling may be achieve by a welded connection or substantially any other type of connection or strategy. Further, track assembly 160 is coupled to interior surface 13 of top member 11 at edge 164 and is further coupled to edge 82 of panel 60 along edge 165 of track assembly 160, while substantially similar track assembly 180 is coupled to surface 13 of top member 11 at edge 184 and is further coupled to edge 62 of panel 60 along edge 185 of track assembly 180. The substantially similar track assemblies 160, 180 are adapted to receive plurality of substantially similar roller bearings 212 which are coupled to trolley member 200 and which movably reside within respective portions 170, 171.

Particularly and as best seen in FIG. 8, trolley member 200 is generally planar and has a first planar surface 188, and a generally flat and opposed planar surface 211. The member 200 further includes a plurality of substantially similar and generally planar edges 201, 204, which are linearly coextensive to length 206 of surfaces 188, 211 and which orthogonally project from the surface 188 forming a "L-shape" with the Surface 211 (i.e., the edges 201, 211 form a right angle with surface 188). Additionally, edge 204 has a slot 189 which is generally rectangular and which is formed on edge 204 at vertical axis 190 of edge 189. Member 200 further includes a plurality of substantially similar and generally planar edges 203, 205 which orthogonally project from surface 188 and which include a plurality of substantially similar reception apertures or holes 207, 208, 209, 210 (i.e., holes 207, 208 reside on edge 203 while holes 209, 210 reside on edge 205). Also, substantially similar holes 207, 208, 209, 210 are coupled to and receive substantially similar roller bearings, such as roller bearing 212, to communicate trolley ember 200 into cavity 130. Roller bearing 212 has a first cylindrical portion 213 which substantially resides within and is coupled to holes 207, 208, 209, 210 at end 216 and which terminates into a circular portion 217 which is coupled to a circular disc 214 (e.g., a wheel). Circular disc 214 has a height 215 which is substantially the same as heights 167 of track assembly 160 and also which is substantially the same as height 187 of track assembly 180, and which causes trolley member 200 to remain coupled to track assemblies 160, 180 when roller bearings 212 are operatively coupled to trolley member 200 and also to track assemblies 160, 180. That is, bearing 212 causes member 214 to move within (e.g., by the use of roller bearings to facilitate movement) the respective cavity 166, 186 of respective track assemblies 160, 180 and thereby moving member 200 along the respective axis formed by the apertures which allow the track assembly to be attached to the panel, such as panel 11 to which it is attached. In this manner, member 200 is constrained to only move in a direction towards and away from the cavity 130. The track assemblies 160, 180 provide an efficient and durable way to selectively retract door assembly 220 without the use of components that can potentially wear out quickly and where these worn out components can further cause damage to the door assembly.

Further, trolley member 200 is coupled to a plurality of "L-shaped" brackets 102, 104. Particularly, bracket 102 has a first portion 114 which is generally planar and which is coupled to surface 211 of member 200 at edge 203, and where bracket 102 has a second portion 116 which is generally "triangular" and which orthogonally projects from portion 114 (i.e., portion 102 forms a right angle with surface 211) and which includes a ball stud 118. Ball stud 118 is a generally "spherical" and which protrudes from surface 120 of portion 116. Also, bracket 104 has a first portion 115 which is generally planar and which is coupled to surface 211 of member 200 at edge 205, and where bracket 104 has a second portion 117 which is generally "triangular" and which orthogonally projects from portion 115 (i.e., portion 104 forms a right angle with surface 211) and which includes a ball stud 119. Ball stud 119 is also generally "spherical" and which protrudes from surface 121 of portion 117.

Further and as best seen in FIGS. 4 and 5, side panels 40, 60 have a plurality of preformed holes 47, 67 formed in edges 45, 65 respectively, and which receive a plurality of substantially similar roller bearings 401, 402 coupled therein, and in one non-limiting embodiment, bearings 401, 402 are substantially the same as roller bearing 212. Each respective roller bearing 401, 402 receive respective guides 269, 274 (see FIG. 11) when door assembly 220 is lifted and retracted into cavity 130, with bearings 401, 402 thereby providing a ledge for door assembly 220 to rest upon when door assembly 220 slides into cavity 130 and which will be described below.

Yet further, hutch assembly 100, as is shown perhaps best in FIGS. 2, 8, 9, 10, and 11, includes a door assembly 220 which has a aesthetically pleasing door handle portion 285.

Figure 10:
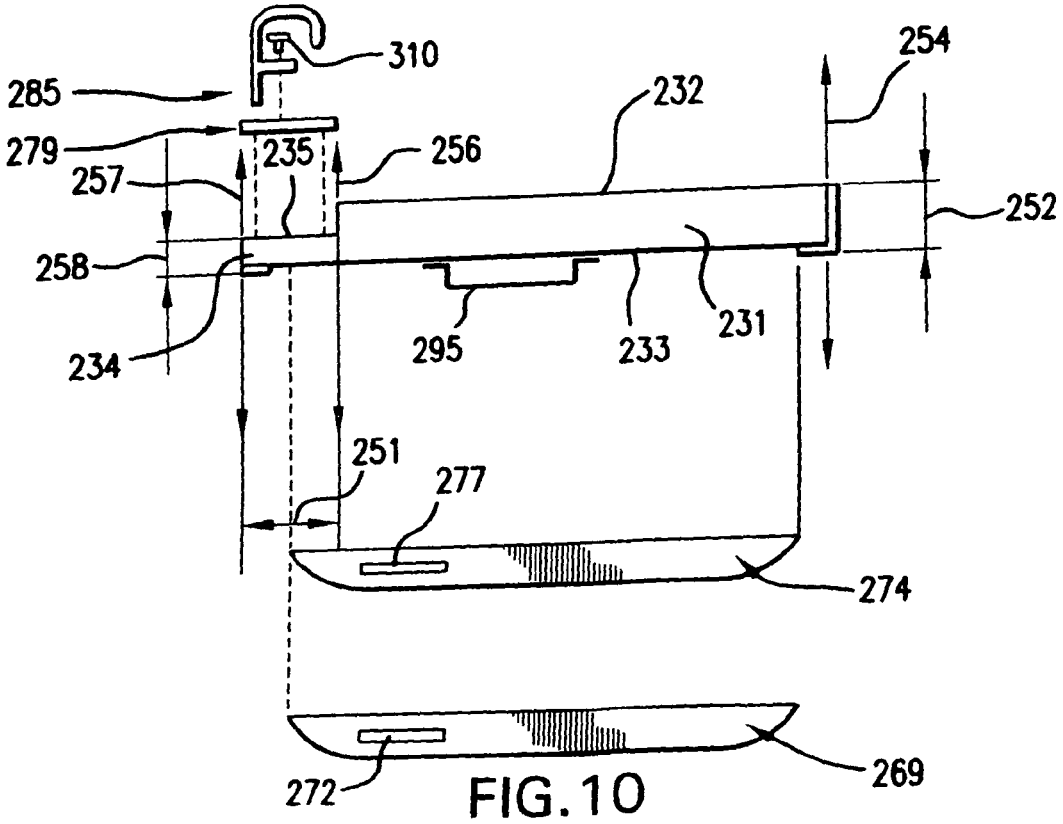
FIG. 10 is a side sectional view of the door assembly of the hutch assembly which is shown in FIGS. 1-2, 9.

Particularly and as seen in FIG. 10, door assembly 220 has a door panel 230 which has a first portion 231 which is substantially planar and which has a uniform thickness 252 from vertical axis 254 to vertical axis 256 and which is linearly coextensive with length 255 of door panel 230 and which has a first planar surface 232 and an opposed and generally planar bottom surface 233 and which terminates into a second portion 234 which is also substantially planar and which has a uniform thickness 258 along width 251 and which is linearly coextensive with length 255 and which has a generally flat first surface 235 and a same opposed and generally flat second surface 233. Further, thickness 252 of first portion 231 is larger than thickness 258 of second portion 234.

Further, door panel 230 has a plurality of substantially similar edges 259, 260 which are linearly coextensive to width 270 of door 230 and which orthogonally project from surface 232 in direction 280 forming a "L-shape" with the surface 233 (i.e., the edges 259, 260 form a right angle with surface 233), while door panel 230 also has a plurality of substantially similar edges 261, 262 which are linearly coextensive to length 255 of door 230 and which orthogonally project from surface 232 in direction 280 forming a "L-shape" with the surface 233.

Figure 11:
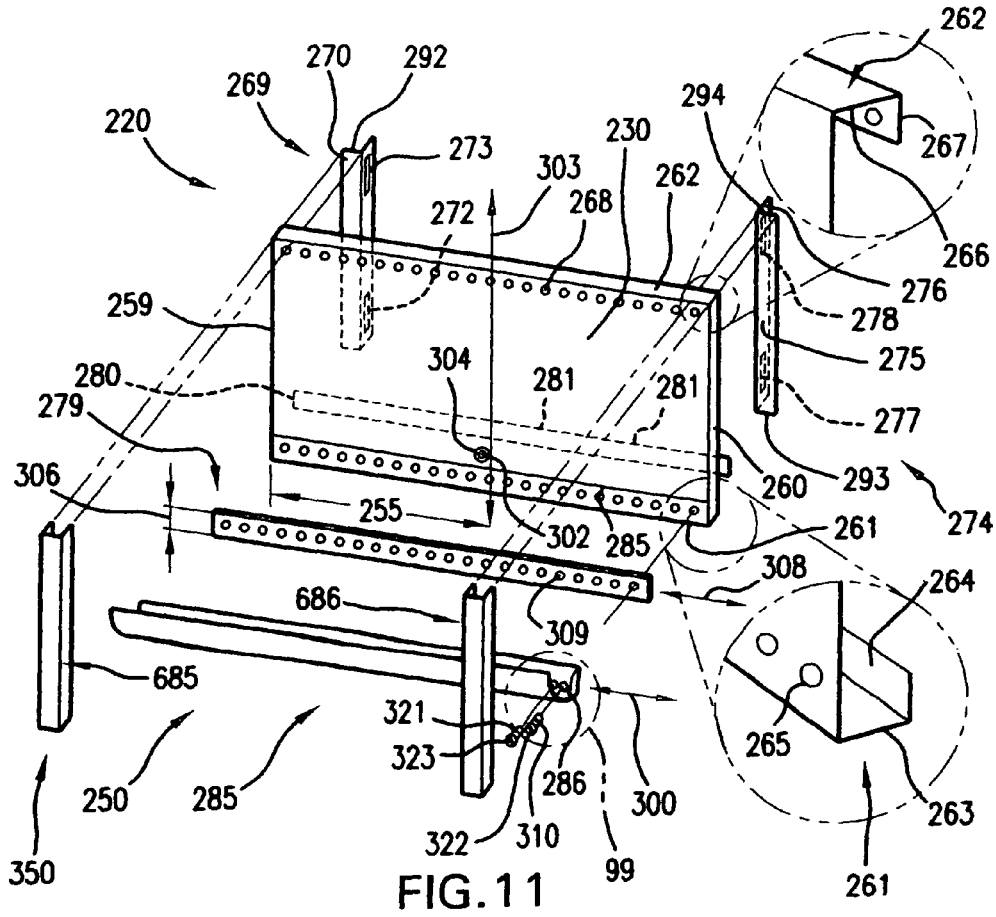
FIG. 11 is a perspective and partial unassembled view of the door assembly which is shown in FIGS. 9-10.

Yet further and as seen in FIG. 11, edge 261 has a first portion 263 which orthogonally protrudes from surface 233 and which terminates into a second portion 264 which is orthogonal to portion 263 (i.e. portion 263 is parallel to surface 233) and which has a plurality of substantially similar and equally spaced holes, such as hole 265, and which is adapted to receive, in one non-limiting embodiment, a screw, bolt, or other type of fastener technique to couple handle portion 285 to edge 261, and which will be described below. Similarly, edge 262 has a first portion 266 which orthogonally protrudes from surface 233, and which terminates into a second portion 267 which is orthogonal to portion 266 (i.e. portion 267 is parallel to surface 233) and which has a plurality of substantially similar and equally spaced holes, such as hole 286, and which is adapted to receive, in one non-limiting embodiment, a screw, bolt, or other type of fastener technique to hinge assembly 340 to edge 261, and which will be described below.

Further and as best seen in FIGS. 10 and 11, Door assembly 220 has a plurality of generally planar and substantially similar "L-shaped" bearing guides 269, 274 which are respectively coupled to respective edges 259, 260 of door panel 230 and which are adapted to respectively receive lock bar guides 280, 281.

Particularly, bearing guide 269 has a first planar portion 270 which is parallel to surface 233 and which is coupled to and is linearly coextensive with edge 259 of door 230 and which terminates into a second orthogonal portion 271 which is linearly coextensive to portion 270 and which has a plurality of guide slots or apertures 272, 273 at ends 291, 292 of guide 269. Slots 291, 292 are generally "rectangular" shaped and are adapted to receive at least first lock bar guide 280 thereby selectively locking and unlocking hutch assembly 100 and which will be described in detail below. Similarly, bearing guide 274 has a first planar portion 275 which is parallel to surface 233 and which is coupled to and is linearly coextensive with edge 260 of door 230 and which terminates into a second orthogonal portion 276 which is linearly coextensive to portion 275 and which has a plurality of guide slots or apertures 277, 278 at ends 293, 294 of guide 274. Slots 277, 278 are similarly "rectangular" shaped and are adapted to receive at least second lock bar guide 281 thereby selectively locking and unlocking hutch assembly 100 and which will be described in detail below. It should be appreciated that respective guides 269, 274 may be attached to respective edges 259, 260 by a welded connection or any other type of attachment technique or strategy.

Further, door assembly 220, as best seen in FIGS. 9, 10, 11, and 12, has a brace or structural support member 295 coupled to interior or bottom surface 233 of door member 230. Particularly, brace or structural support member 295, when attached to the surface 233, is linearly coextensive to width 255 of interior surface 233, is parallel to axis 296 of interior surface 233 and comprises an integrally formed trough member or portion 297. Particularly, the trough member or portion 297 has a first flat raised lip portion 298 which is coupled to the surface 233 by, in one non-limiting embodiment, the use of bonding adhesive methodology. Member 297 also has a second flat raised lip portion 299 which is similarly coupled to the surface 233 by the use of bonding adhesive methodology. The brace member 297 structurally adds rigidity to the door assembly and strengthens the door assembly 220 by preventing the door panel 230 from "flexing" (i.e., prevents panel 230 from twisting due to the weight of the door panel 230) while providing a door assembly 220 that does not have unsightly weld type connections farmed on the inside surface 233 of the door assembly 220, thereby providing a hutch assembly 100 that has a door assembly 100 which has an overall aesthetically pleasing appearance, especially when one views the front of the hutch assembly 100 (i.e., the term "front" means the portion of the hutch assembly 100 upon which the door assembly 100 is deployed).

Figure 9:
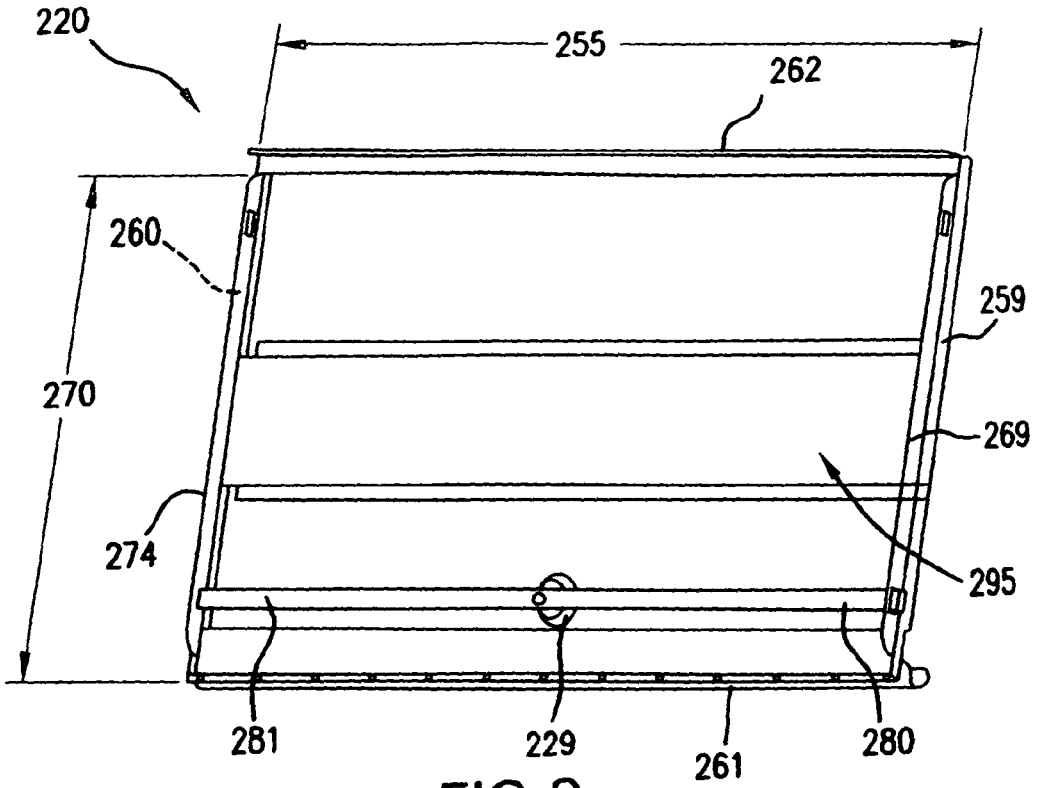
FIG. 9 is a back view of the door assembly of the hutch assembly which is shown in FIGS. 1-2.
Figure 13:
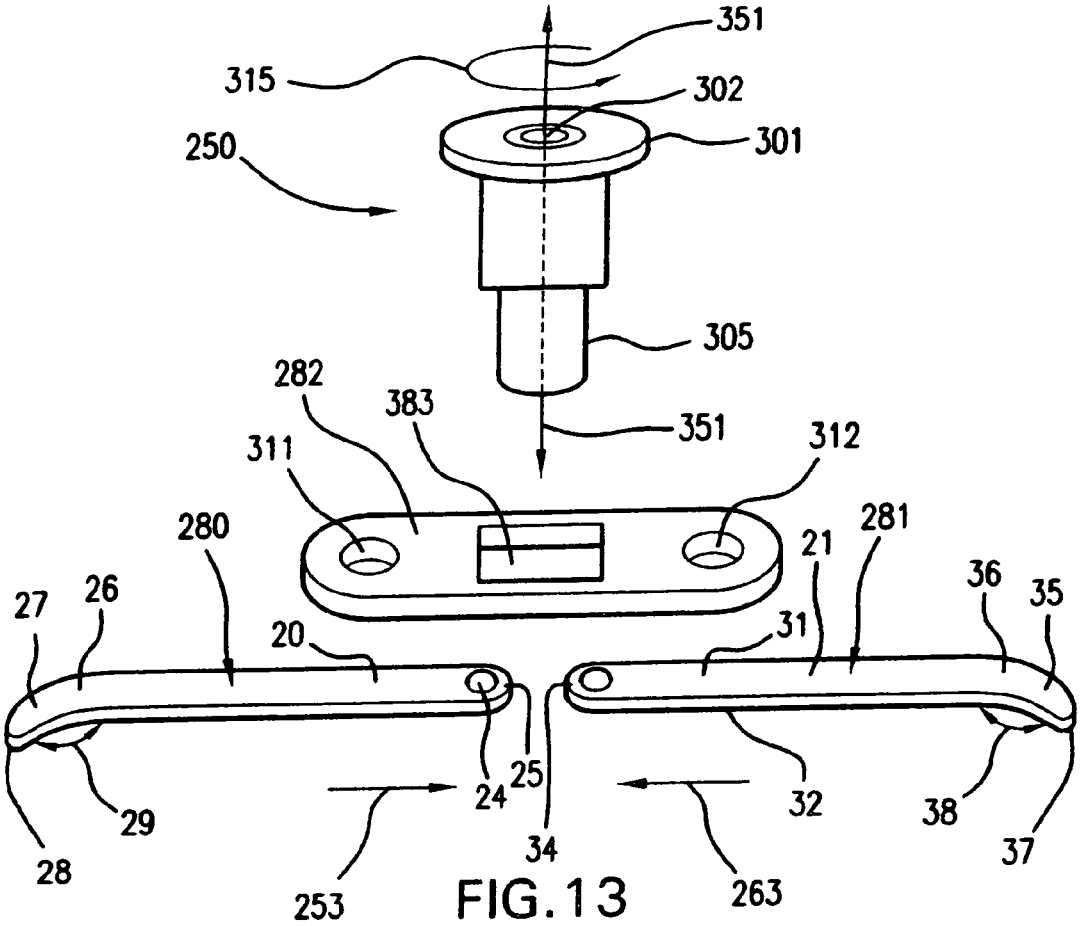
FIG. 13 is a perspective and unassembled view of a lock bar assembly of the hutch assembly which is shown in FIG. 9.

Yet further, and as seen in FIGS. 9 and 13, the door locking assembly 250 of the preferred although non-limiting embodiment of the invention, comprises lock bar members 280, 281 which are coupled to locking mechanism 301 through a cam portion 282. Cam Portion 282 is generally planar and has a centrally formed and substantially rectangular aperture 283 along axis of symmetry 351 of cam 282 and has a plurality of opposed apertures 311, 312 formed at opposed ends of cam 282 and where respective apertures 311, 312 which are coupled to a plurality of respective and substantially similar "L-shaped" Lock bar members 280, 281. Lock bar member 280 has a first planar portion 20 which has a first surface 22 and an opposed second surface 23 and which has a preformed aperture 24 located at end 25, and portion 20 terminates into a second portion 26 and which has a first surface 27 and an opposed second surface 28 and where second surface 28 forms an angle 29 with surface 23. Further, lock bar member 281 has a first planar portion 21 which has a first surface 31 and an opposed second surface 32 and which has a preformed aperture 33 located at first end 34, and portion 21 terminates into a second portion 35 and which has a first surface 36 and an opposed second surface 37 and where second surface 37 forms an angle 38 with surface 32. Angles 29, 37, in the one non-limiting embodiment, are generally obtuse. Also, cam 282 is coupled to lockbar guides by coupling respective holes 311, 312 to respective holes 24, 32 of guides 280, 281, and this coupling could be achieved by a welded connection or any other type of attachment technique or strategy.

The door locking assembly 250 (as seen in FIG. 11) also includes a plurality of lock bar guides 269, 274, which receive lock bar members 280, 281 respectively. Particularly, lock bar guide 269 has a generally "rectangular" slot 272 formed at end 291 and which receives portion 26 of lock bar member 280 while lock bar guide 274 has a substantially similar and rectangular slot 277 at end 193 and which receives portion 35 of lock bar member 281. The drawer locking assembly 250 further includes a selectively lockable mechanism 301 having an end portion 305 which is coupled to aperture 283 of cam 282. Locking mechanism 301 includes a selectively "turnable" key receptacle portion 302 which, when a key (not shown) is inserted, causes the mechanism 301 (e.g., a conventional tumbler) to selectively move in a clockwise or counterclockwise direction), and which further causes the portion 305 to respectively around in the same clockwise or counterclockwise direction. The portion 305 residing within aperture 283 of cam 282 causes the lock bar members 280, 281 to be pulled towards axis 351 or pushed away from axis 351, and which will be described below.

As is best shown in FIG. 11, the hutch assembly 100 further includes a trim portion 279 coupled to surface 235 of portion 234 and which has a width 306 which is at least the width 251 of portion 234, and which further has a plurality of substantially similar and equally spaced apertures, such as aperture 309 which are linearly coextensive with length 255 of door 230 and which are on axis 308 which are aligned with axis 307 of aperture 265. The door trim 279 may be constructed from plastic or some other type of composite material and is fastened to a door by the use of glue. Further, it should be appreciated that the trim portion 279 reflects light rays, such as light ray 350, which may impinge upon it, thereby creating an aesthetically pleasing overall appearance, especially when one views the front of the hutch assembly 100.

Figure 14:
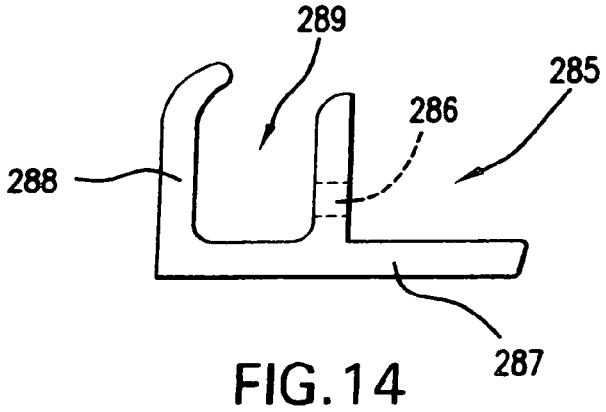
FIG. 14 is a partial exploded view of the door handle portion of the door assembly which is shown in FIG. 11 and which is taken around the area which is labeled as "99" in FIG. 11.

Yet further and as shown in FIGS. 11, 14, the hutch assembly 100 further includes a handle portion 285 which may be selectively attached to the door assembly 230, such as by the use of rivets or bolts, such as bolt 310, and allows a user to conveniently open the hutch assembly 100 (i.e., in order to allow the hutch assembly 100 to be efficiently opened and the cavity 130 accessed) while also providing an aesthetically pleasing overall appearance to door hutch assembly 100.

Yet further and as best seen in FIG. 14, handle 285 has a first, generally "U-shaped" portion 288 and further includes an interior portion of the "U-shape" 289 being directed toward the locking mechanism 301 and which has a plurality of substantially similar and equally spaced holes 286 aligned on a preformed line or axis 300. Handle portion 285 is coupled to door assembly 230 by aligning pre-formed line or axis 300 of holes 286 with axis 308 of holes 309 of trim 279 and further aligning portion 285 with pre-formed line or axis 307 of holes 265 of door panel 230, and coupling handle 285 to trim 279 to door panel 230 by attaching a plurality of bolts, such as bolt 310, to the handle 285 by passing bolt 310 through respective plurality of holes 286, 309, 265 of respective portions 285, 279, and 234. It should be appreciated that the interior portion 289 is a convenient place for a user to grasp the hutch assembly 100 in order to selectively open hutch assembly 100 from a first closed position to an extended position and back to the closed position. Further, in the most preferred, although non-limiting, embodiment of the invention, the handle 285 includes a projecting portion 287 which integrally terminates into the "U-shaped" portion 288 and which abuts and is connected to the edge 261 of door 230 of door assembly 220. Such connection may be made by the use of a conventional fastener or a fastener adhesive or some other type of conventional fastener strategy or methodology.

Figure 15:
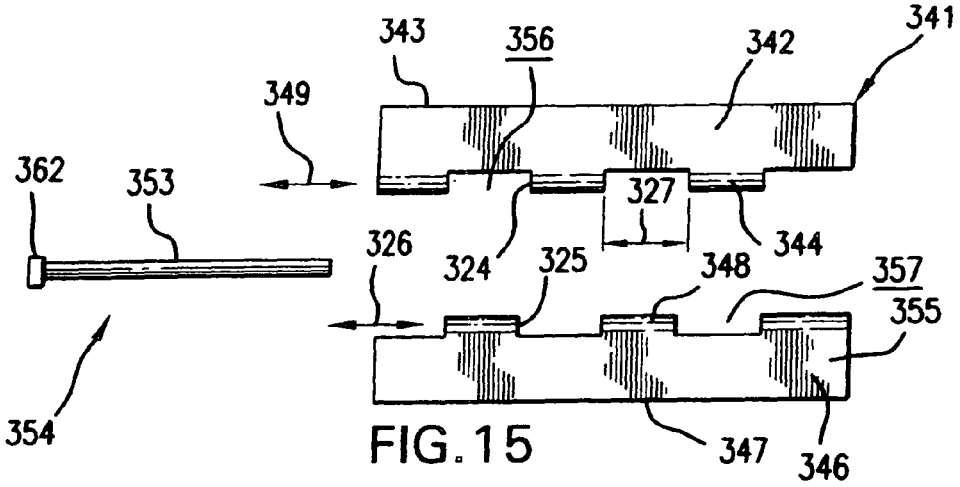
FIG. 15 is a perspective view of the hinge assembly of the hutch assembly which is shown in FIG. 2.

Yet further, and is best seen in FIGS. 2 and 15, hutch assembly 100 has a hinge assembly 340 coupled to door assembly 220. Particularly, hinge assembly 340 has a first generally planar portion 341 which has a first surface 342 and a second opposed surface 343 and which terminates into a plurality of substantially similar and equally spaced teeth, such as tooth 344. Substantially similar teeth, such as tooth 344, are aligned along a preformed axis 349, and are separated by substantially similar grooves, such as groove 356. Tooth 344, is generally "cylindrical" and contains an interior cavity 324 which is linearly coextensive to length 327 of tooth 344. Hinge assembly 340 also has a second generally planar portion 345 which has a first surface 346 and a second opposed surface 347 and which terminates into a plurality of substantially similar and equally spaced teeth, such as tooth 348. Substantially spaced circular teeth, such as tooth 348, are aligned along a preformed axis 326, and are separated by substantially similar grooves, such as groove 357. Similarly, tooth 348 is generally "cylindrical" and contains an interior cavity 325, which is linearly coextensive to length 328 of tooth 348. Portion 341 is coupled to portion 345 by aligning axis 349 with axis 326 and inserting tooth 344 into a respective groove 357, and furthermore inserting tooth 348 into a respective groove 356, and inserting pin 351 into cavities 324, 325 so that cylindrical portion 352 of pin 351 passes through teeth 344, 348, thereby locking portion 341 with portion 345. Hinge assembly 340 will pivot on axes 349, 326. Further, door assembly 230 is coupled to body 912 by coupling surface 342 of portion 341 to edge 201 of trolley member 200 while surface 346 of portion 345 is coupled to inside edge 267 of door 230, thereby allowing door assembly 230 to also pivot along axes 326, 349. Door assembly 220 may now be selectively rotated along axes 329, 349.

Figure 12:
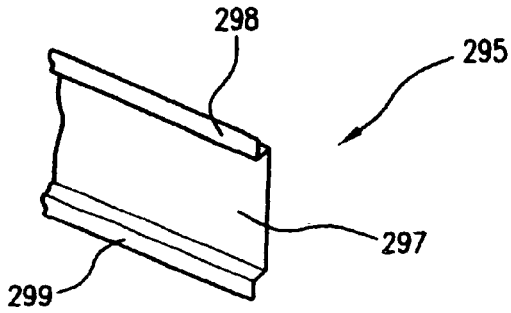
FIG. 12 is a partial perspective view of the reinforcement guide of the hutch assembly which is shown in FIGS. 1-2, 9-10.
Figure 27:
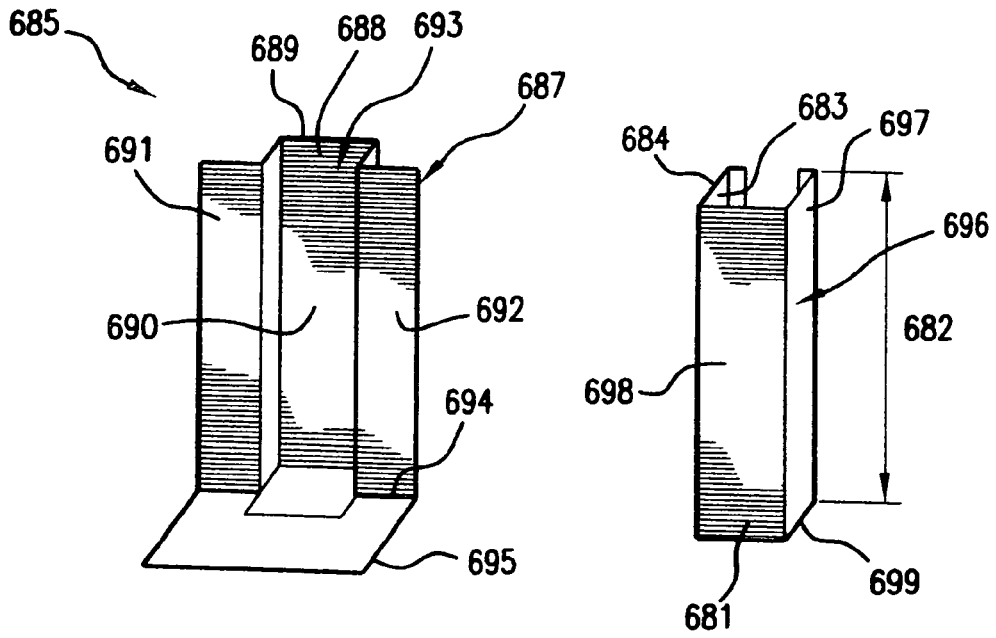
FIG. 27 is an unassembled view of the trim member of the side cabinet assembly and which is taken in the area labeled "970" in FIG. 21.

Yet further, and as seen in FIGS. 12, 27, door assembly 220 further has a plurality of substantially the same trim portions 685, 686, and which are coupled to top surface 232 of door 230 along edges 259, 260 respectively. Particularly, trim portion 685, such as trim portion 685, has a generally "U-shaped" portion 687 which abuts the front surface 232 of the door 230 and further includes a "C-shaped" reflective portion 696 which is coupled to portion 687.

Particularly, portion 687 has a first channel portion 688 which has a first planar surface 689 which is coupled to surface 232, and an opposed and generally planar surface 690, and this coupling could be made by an adhesive type connection or substantially any other type of connection technique. Further, portion 687 has a plurality of raised edges which 691, 692 which are linearly coextensive with surfaces 689, 690 and which orthogonally project from surface 690 forming a generally "L-shape" with surface 690 (i.e., edges 691, 692 form a right angle with surface 690). Portion 687 has a first end 693, which is generally open, and terminates into a second orthogonal portion 695 at second end 694. Portion 695 provides an abutment for containing reflective portion 696 at end 695 thereby keeping portion 696 securely coupled to portion 687.

As best seen in FIG. 27, portion 685 also has a "C-shaped" reflective portion 696 which has a first planar portion and which is coupled to a plurality of substantial similar and orthogonal edges 684, 697. Edges 684, 697 cooperate to form a channel 683, which is linearly coextensive with length 682 and which receives edges 687, 691 (i.e., edges 687, 691 reside within cavity 683 along the entire length of member 696). Further, portion 696 is restrained at end 699 by portion 695, thereby keeping portion 696 coupled to portion 687 and preventing portion 696 from sliding out of contact with portion 687. It should be appreciated that surface 681 of portion 696 may be painted or powder coated before being installed, thereby providing a consistent finish which reflects light rays, such as light ray 350 (as seen in FIG. 11), which may impinge upon it, thereby creating an aesthetically pleasing overall appearance, especially when one views the front of the hutch assembly 100 (i.e., the term "front", in this context, means the portion of the hutch assembly 100 upon which the trim portion 685 is deployed).

Figure 21:
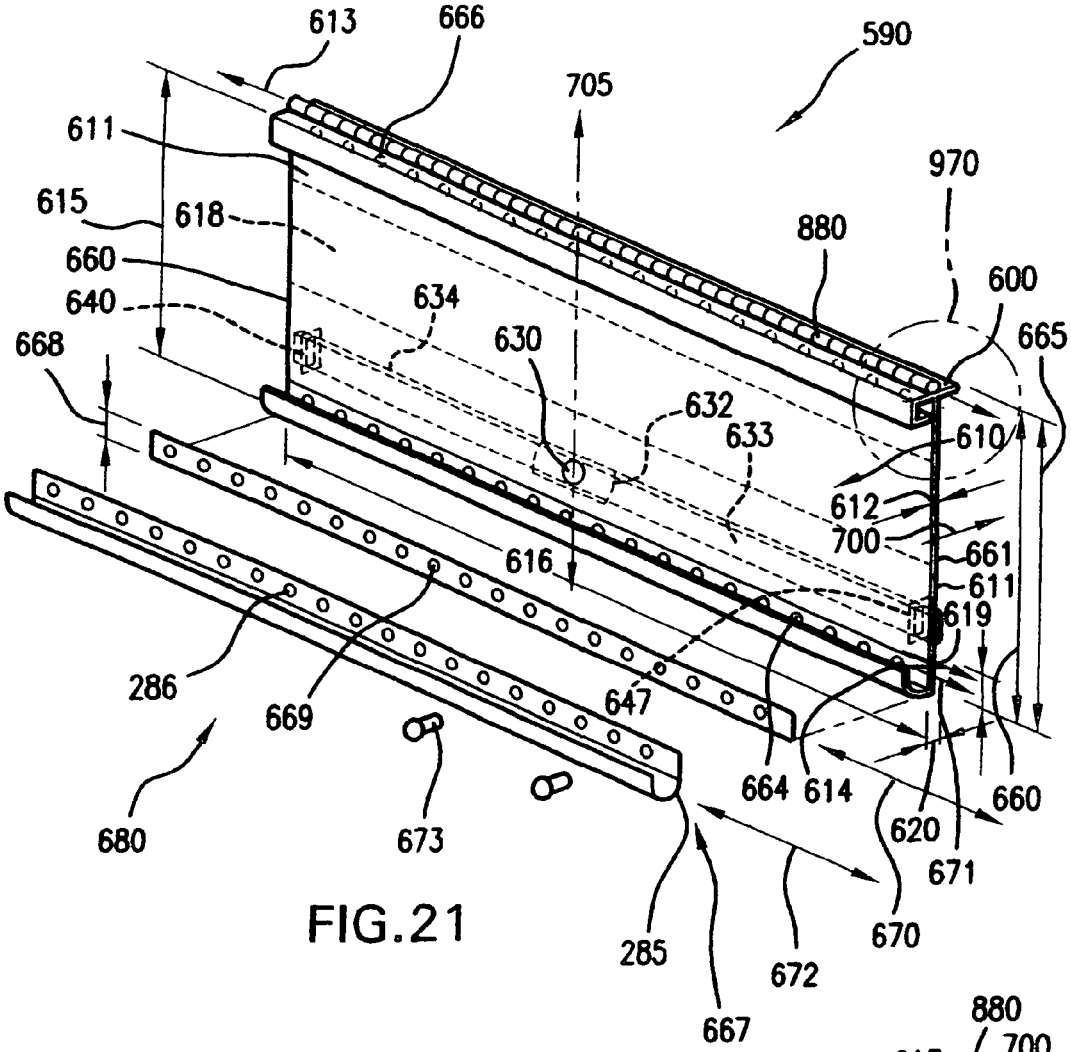
FIG. 21 is a perspective and unassembled view of the door assembly of the side cabinet assembly which is shown in FIGS. 1, 16.

Further, and as seen in FIGS. 9, 21, and 13, first planar portion 231 has an integrally formed trough portion 229 which is formed in top surface 232 (i.e., trough 229 is a depression formed or embossed in surface 232) to receive a selectively lockable mechanism 301 (i.e., the locking mechanism 301 includes a selectively "turnable" key receptacle portion 302 which, when a key (not shown) is inserted, causes the mechanism 301 (e.g., a conventional tumbler) to selectively move in a'clockwise or counterclockwise direction). Particularly, trough portion 229 is recessed or embossed in top surface 232 (i.e. trough portion 229 forms a divot in surface 232) along axis of symmetry 303 of door panel 230 and has aperture 304 which receives locking mechanism 301. The locking mechanism 301 is coupled to a cam portion 282 and to a plurality of bar members 280, 281 and which allows the door assembly 220 to be selectively locked and unlocked.

Figure 30:
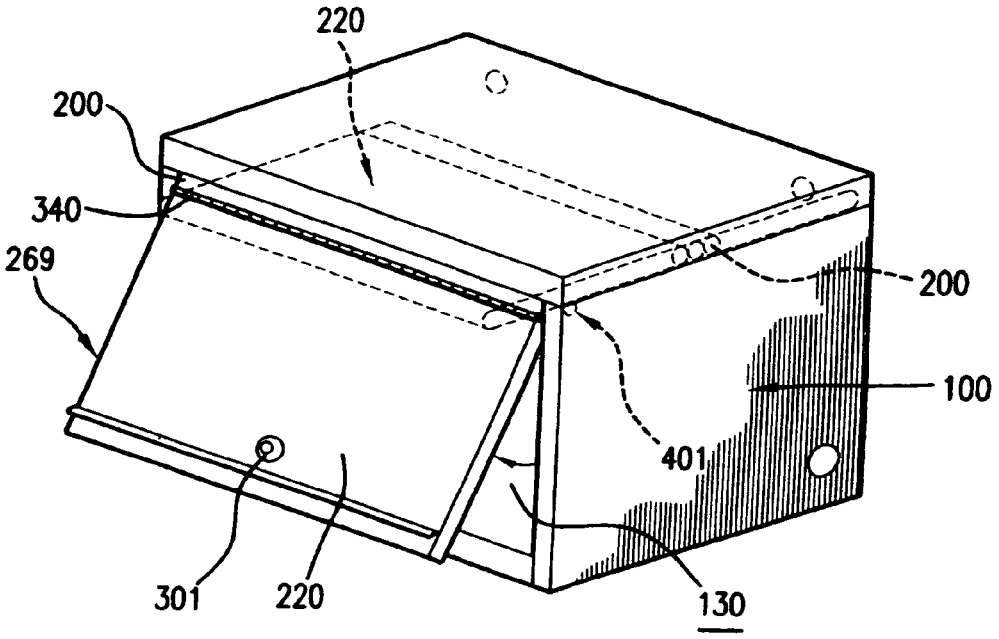
FIG. 30 is a perspective view of the hutch assembly which is shown in FIG. 2 but which illustrates the selective movement of door assembly to an open position.

In operation, and as seen in FIG. 30, when it is desired to unlock the hutch assembly 100 (i.e., to allow the movement of door assembly 220 into the cavity 130), the lock 301 is turned in a counterclockwise direction along arc 315 (see FIG. 13) which causes the cam 282 to similarly rotate in a counterclockwise direction (due to the movement of the end portion 305), and which causes the guide 280 to move in direction 253 toward axis 351 while also causing guide 281 to move in direction toward axis 351 (i.e., to draw guides 280, 281 in toward axis 351 respectively). This movement causes the respective end portion 26, 35 of guides 280, 281 to be removed or retracted from respective apertures 63, 83 of respective side panels 40, 60, thereby removing end portions 26, 35 from abutting guides 269, 274 and therefore selectively unlocking the hutch assembly 100. The door assembly 220 may be selectively retracted into cavity 130 by grasping door handle portion 285 and sliding door assembly 220 into cavity 130 which causes roller bearing 212 to move within (e.g., by the use of roller bearings to facilitate movement) the respective cavity 166, 186, of respective track assemblies 160, 180, and thereby moving member 200 into cavity 130 of body 912 along the respective axis formed by track assemblies 160, 180. Further, as door assembly 220 is retracted into cavity 130, guides 269, 274 support door assembly 220, as door assembly 220 rests upon roller bearings 401, 402 as door assembly 220 is retracted into cavity 130. Each respective roller bearing 401, 402 receives respective guides 269, 274, and holds door assembly 220 open when door assembly 220 is stored in an open position.

Figure 16:
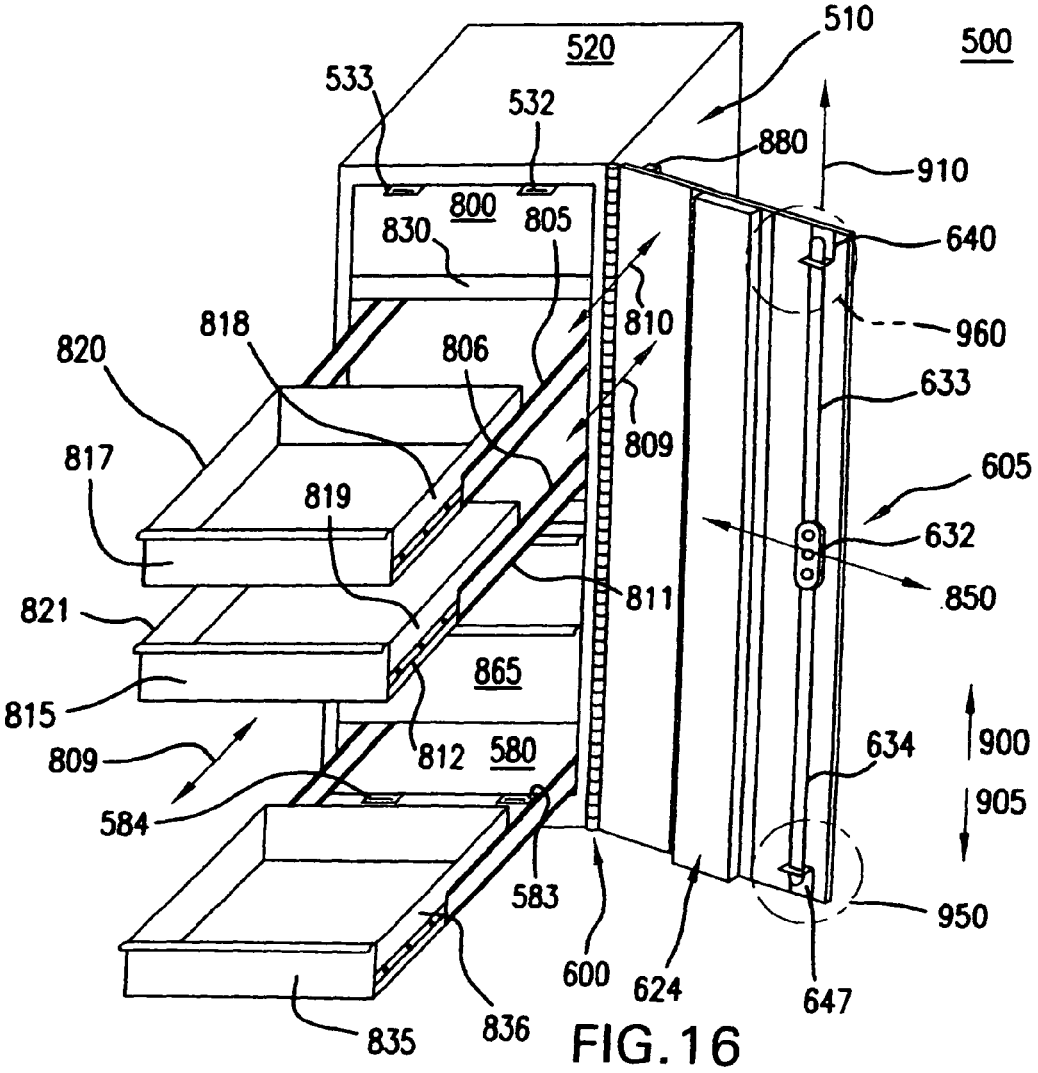
FIG. 16 is a perspective view of the side cabinet assembly and which illustrates the selective movement of drawers to an open position employed by the preferred embodiment of the invention.

Referring now to FIGS. 1, 16, there is shown a side cabinet 500 which is made in accordance with the teachings of the preferred embodiment of the various inventions. Particularly, the side cabinet assembly 500 includes a generally hollow body 510 which is selectively formed by a plurality of members which will be discussed below and which is adapted, as is evident from the discussion below, to selectively and movably receive drawers and selectively receive shelves, with the drawers and shelves themselves adapted to selectively and receive and store tools and/or other items and which allows these received tools and/or other items to be efficiently accessed and then later deposited into the side cabinet assembly for secure storage.

Figure 17:
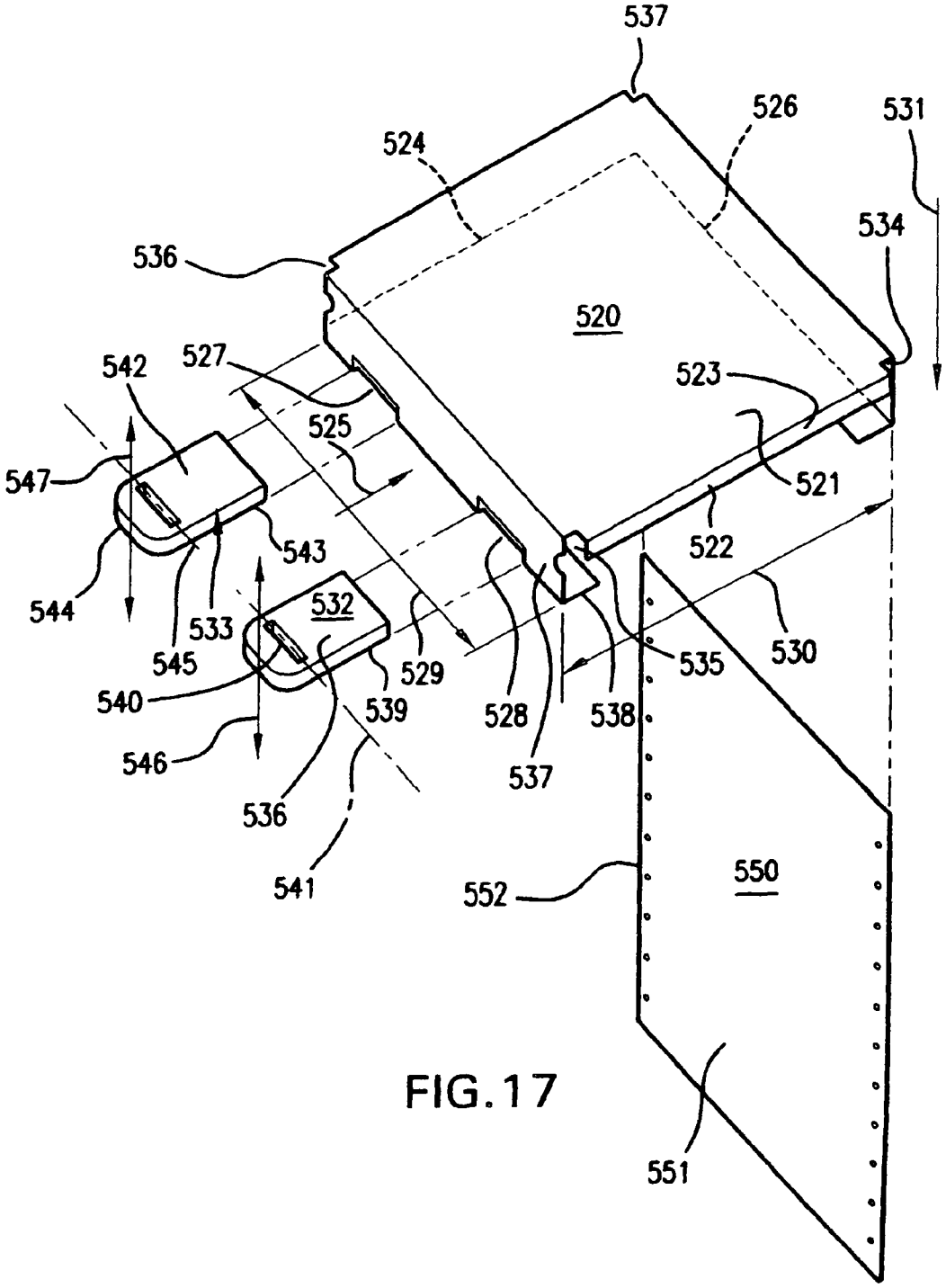
FIG. 17 is a partial unassembled perspective view of the top panel member and back panel member for the side cabinet assembly which is shown in FIGS. 1, 16.

The side cabinet assembly 500, as best seen in FIG. 17 includes a stainless steel top member 520 and a plurality of latches 532, 533. The member 520 may, of course, be constructed from a variety of materials and nothing in this description limits the side cabinet assembly 510 to only on or several specific types of materials.

As is shown perhaps best in FIG. 17, top member 510 has a first generally planar surface 521, and an opposed and generally flat interior or bottom surface 522. The top member 510 further includes a plurality of substantially similar and generally planar edges 523, 524 which are linearly coextensive to width 530 and which orthogonally projects from the surface 521 in direction 531, and a back edge which is linearly coextensive with length 529 and which orthogonally projects from the surface 521 in direction 531, and also a front edge which also is linearly coextensive to length 529 and which orthogonally projects from surface 521 in direction 531 forming a "L-shape with the surface 522 (i.e., edges 523, 524, 525, 526 form a right angle with surface 522). "L-shaped" edge 525 has a first portion 537 which is orthogonal to surface 522 and which terminates into second portion 538 which is parallel to surface 522. Further, edge 525 has a plurality of substantially similar pre-formed apertures 527, 528 and which are formed at the intersection of portions 537 and 538 and which receive substantially similar latches 532, 533.

Also, latch 532 has a generally planar body and has a generally first surface 538 and an opposed second surface 539 and a "rectangular" shaped aperture 540 which is formed along pre-determined axis 541 while latch 533 has a generally planar body and has a first surface 542 and an opposed second surface 543 and a "rectangular" shaped aperture 544 formed along a pre-determined axis 545. Respective latches 532, 533 are coupled to top member 520 at portion 538 of edge 525 and reside within respective apertures 528, 527, of member 520. Respective apertures 540, 544 are aligned along axes 546, 547, and axis 546 is aligned against axis 910 of lock bar guides 633, 634 as shown in FIG. 16. Also, latches 532, 533 may be attached by substantially any desired connection strategy or technique, such as by adhesive, welded connection, or any other type of connection technique or strategy. Also, top member 520 has grooves at corners 534, 535, 536, 537 at surface 521 and are provided to receive the other panels which form body 510 and which will be discussed later.

The side cabinet assembly 500 further includes a generally planar back panel 550(shown perhaps best in FIG. 17) which is orthogonally coupled to the top member 520 along edge 526 (e.g., panel 550 form a right angle with respect to top member 520) and which resides within grooves 537, 534 and such coupling may be achieved by the use of a welded type connection or substantially any other type of connection strategy or technique.

Further, as shown perhaps best in FIGS. 16 and 20, the side cabinet assembly 500 includes a generally planar bottom member 580 having substantially similar latch members 583, 584 as latch members 532, 533 coupled therein, and generally planar and substantially identical end panels 560, 570 which are respectively coupled along respective edges 563, 573 to the bottom member 580 along edges 581, 582, and which are respectively coupled along respective edges 562, 572 to the interior surface 551 of back panel member 550 and which are respectively coupled along respective edges 564, 574 to the top member 520, and, in one non-limiting embodiment, panel 560 is coupled to door assembly 590 along edge 561, although panel 570 may be coupled to door assembly 590 along edge 571. In this manner, the members 520, 550, 560, 570, and 580 form a generally hollow body 510 (e.g., forming a cavity 800) into which various items may be selectively deposited for secure storage and then later retrieved for use.

In one non-limiting embodiment, side cabinet assembly 500 may be selectively attached to hutch assembly 100 at either panel 40 or panel 60 of hutch assembly 100 and thereby provide a side cabinet and hutch system 10 that is interchangeable based on preference of users.

Particularly, panel 560 has a plurality of substantially similar holes 565, 566, 567 and which are provided to couple panel 560 of side cabinet assembly 500 to panel 40 of hutch assembly 100 at respective holes 55, 56, 57, while panel 570 has a plurality of substantially similar holes 569, 569, 575, and which are provided to couple panel 570 of side cabinet assembly 500 to panel 60 of hutch assembly 100 at respective holes 75, 76, 77, and this coupling may be may be made by substantially any desired connection strategy or technique, such as by rivets or other type of fasteners and/or welded connection. In this way, side cabinet assembly 500 may be "configured" to selectively couple panel 570 to respective panel 40 or may be configured to selectively attach panel 560 to panel 60. Thus, side cabinet assembly 500 is provided to be deployed upon either panels 40, 60 and provide a side cabinet and hutch system 10 that provides added functionality to a toolbox system. It should be appreciated that latch members 532, 583 are selectively utilized together to receive lock bar members 633, 634 respectively while latch members 533, 584 are selectively utilized together to receive lock bar member 633, 634 respectively, and system 10 thereby provides a user to selectively configure the door assembly 590 by further rotating door assembly 590 (seen in FIG. 21) clockwise or counterclockwise to accommodate coupling of side cabinet assembly 500 to hutch assembly 100 in either configuration. That is, door assembly 590 is interchangeably and selectively coupled to hinge 600 and is further coupled to respective surface of edge 662 and respective edge 662 may be selectively are respectively coupled to edges 561, 571 of respective panels 560, 570. In this manner, the side cabinet assembly 500 is interchangeable and adds further functionality to the side cabinet and hutch system. Also, It should be appreciated that the generally "rectangular" apertures 587, 588 of respective latches 583, 584 are respectively aligned on respective axes 585, 586, and which is substantially the same as axes 546, 547 of latches 532, 533. It should also be appreciated that such coupling may be achieved by the use of a welded connection, by rivets, or by any other type of fastener methodology or strategy. It should be appreciated that panels 560, 570 may be powder coated and/or painted before being installed and that all other panels and components of the side cabinet assembly 500 may be similarly painted and/or powder coated before being installed, thereby reducing the effort needed to construct the side cabinet assembly 500 while providing a consistent finish ad a pleasing overall aesthetic appearance. It should also be appreciated that the use of multiple or "double" panels increases the structural integrity and strength of the side cabinet assembly 500.

As is best shown in FIGS. 1, 16, 18, 19, and 21, side cabinet assembly 500, includes a door assembly 590 which may be selectively and interchangeably attached to panels 560, 570 by the use of a hinge assembly 600 and allows a user to selectively enclose the cavity 800 within body 510.

Particularly, door assembly 590 is substantially similar to door assembly 230 as was seen in FIG. 21, and has a door panel 610 which has a first portion 611 which is substantially planar and which has a uniform thickness 612 from axis 613 to axis 614 and which is linearly coextensive with height 616 of door 610 and which has a first planar surface 617 and an opposed and generally planar interior surface 618 and which terminates into a second portion 619 which is also substantially planar and which has a uniform thickness 620 along width 621 and which is linearly coextensive with height 616 and which has a generally flat first surface 622 and the same opposed and generally flat second surface 618 as portion 611 (i.e., portion 619 is a valley in door 610 which extends for length 616). Further, thickness 612 of first portion 611 is larger than thickness 620 of second portion 619.

Further, door panel 610 has a plurality of substantially similar edges 660, 661 which are linearly coextensive to width 665 of door 610 and which orthogonally projects from surface 618 direction 700 (i.e., the edges 660, 661 form a right angle with surface 618), and which also has a plurality of edges 662, 663 which are linearly coextensive to height 616 and which orthogonally project from surface 618 in direction 700 forming a "L-shape" with the surface 618. Edge 663 has a plurality of substantially similar preformed apertures, such as aperture 664, and which are adapted to receive, in one non-limiting embodiment, a screw, bolt, or other type of fastener technique to couple handle portion 665 to edge 663, and which will be described below. Similarly, edge 662 has a plurality of substantially similar preformed apertures, such as aperture 666, and which are adapted to receive, in one non-limiting embodiment, a screw, bolt, or other type of fastener to couple edge 662 to hinge assembly 600 which will be described below.

Figure 22:
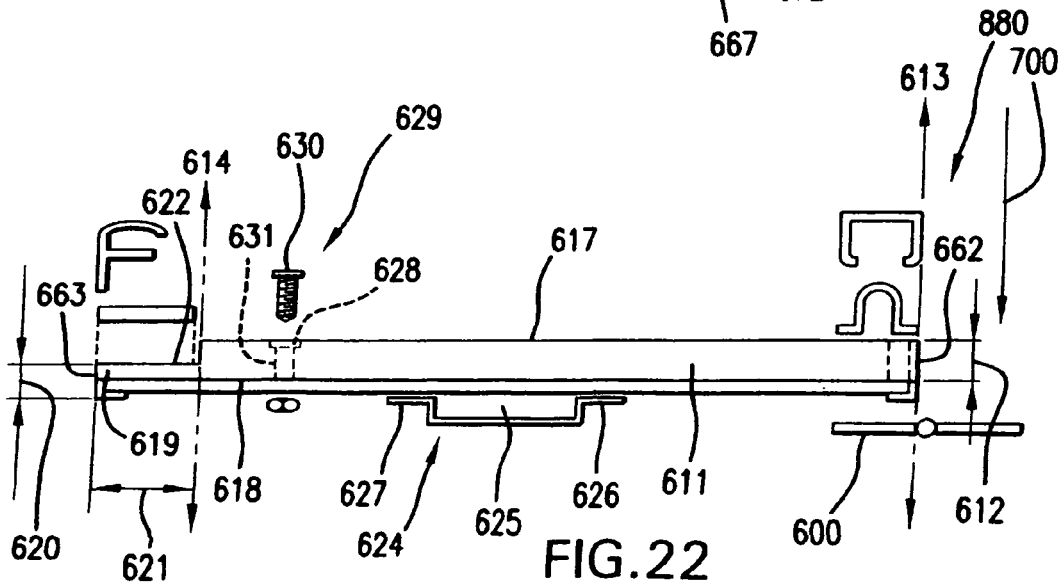
FIG. 22 is an unassembled side view of a door assembly of the side cabinet assembly which is shown in FIGS. 16, 21.

Door assembly 590, as best seen in FIGS. 16 and 22, has a brace or structural support member 624 coupled to interior or bottom surface 618. Particularly, brace or structural support member 624, when attached to the surface 618, is linearly coextensive to length 616 of interior surface 618. Brace 624 has an integrally formed trough member or portion 625 which has a first flat raised lip portion 626 which is coupled to surface 618 and a second flat raised lip portion 627 which is similarly coupled to the surface 618, and portions 626, 627 are coupled to surface 618 by the use of, in one non-limiting embodiment, adhesive methodology although other connection techniques may be utilized. The brace member 624 structurally strengthens the door assembly 590 while providing a door assembly 590 that does not have unsightly weld type connections formed on the inside surface 618 of the door assembly 590 and which undesirably disrupts the overall appearance of the side cabinet assembly 500.

Figure 24:
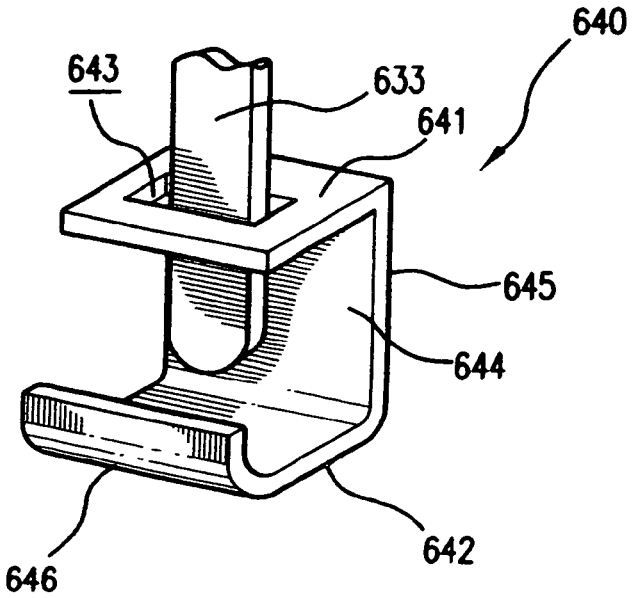
FIG. 24 is a perspective and unassembled view of a lock bar assembly of the side cabinet assembly and which is taken in the area labeled "960" in FIG. 16.
Figure 25:
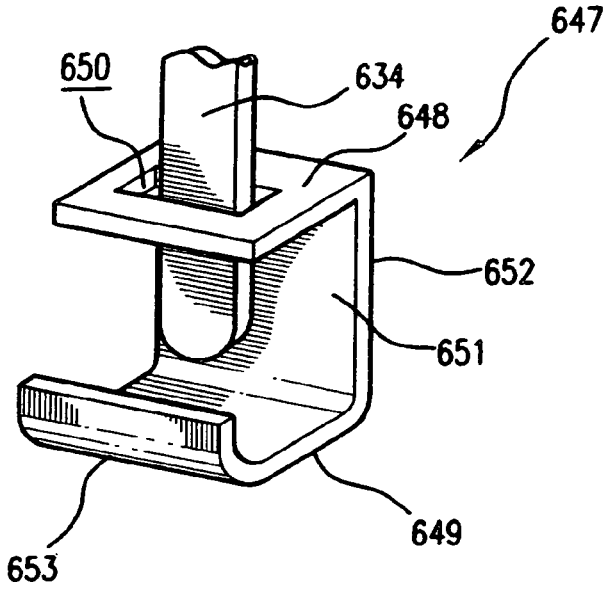
FIG. 25 is a perspective and unassembled view of a lock bar assembly of the side cabinet assembly and which is taken in the area labeled "950" in FIG. 16.

Door assembly 590, as best seen in FIGS. 24 and 25, has a plurality of generally planar and substantially similar "C-shaped" lock bar guide members 640, 647. Guide member 640 is generally planar and has a first surface 644 and a generally flat and opposed second surface 645 and which has a first edge 641 which orthogonally projects from surface 644 and is linearly coextensive with surfaces 644, 645 and which has a reception aperture 643 which is generally "rectangular", and a second edge 642 which orthogonally projects from surface 644 and forms a generally "L-shaped" portion with surface 644. Similarly, Guide member 647 is generally planar and has a first surface 651 and a generally flat and opposed second surface 652 and which has a first edge 648 which orthogonally projects from surface 651 and is linearly coextensive with surfaces 651, 652 and which has a reception aperture 650 which is generally "rectangular", and a second edge 649 which orthogonally projects from surface 651 and which forms a generally "L-shaped" portion with surface 651. Respective lock bar guides 640, 647 are coupled along respective edges 642, 649 to edges 660, 661 of door panel 610 while guides 640, 647 are coupled along respective surfaces 645, 652 to surface 618 of door panel 610.

Figure 23:
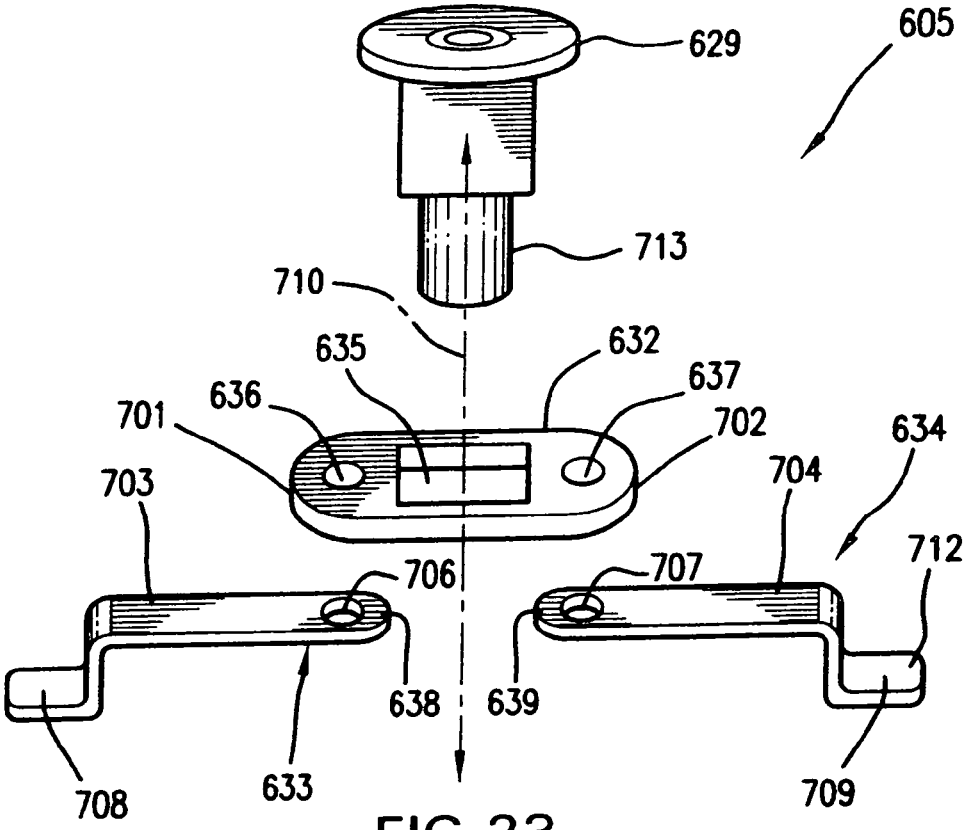
FIG. 23 is a perspective and unassembled view of a lock bar guide of the side cabinet assembly which is shown in FIGS. 16, 21, and 22.

Further and as seen in FIG. 22, first planar portion 611 of door portion 610 has an integrally formed trough portion 628 which is formed in top surface 617 (i.e., trough 628 is a recession formed or embossed in surface 617 in direction 700) to receive a selectively lockable mechanism 629 which is substantially similar to locking mechanism 301 as seen in FIG. 13 (i.e., the locking mechanism 629 includes a selectively "turnable" key receptacle portion 630 which, when a key (not shown) is inserted, causes the mechanism 629 (e.g., a conventional tumbler) to selectively move in a clockwise or counterclockwise direction). Particularly, trough portion 628 is recessed or embossed in top surface 617 (i.e. trough portion 628 forms a divot in surface 617) along axis of symmetry 705 and has aperture 631 which receives locking mechanism 629. The locking mechanism 629 is coupled to a cam portion 632 and to a plurality of substantially similar lock bar members 633, 634 (see, for example, FIG. 23 which will be discussed more fully below) and which allows the door assembly 590, to be selectively locked and unlocked.

As best seen in FIGS. 16, 23, 24 and 25 the door locking assembly 605 of the most preferred although non-limiting embodiment of the invention comprises lock bar members 633, 634 which are coupled to locking mechanism 629 through a cam portion 632. Cam portion 632 is generally planar and has a centrally formed and substantially rectangular aperture 635 along axis of symmetry 710 of cam 632 and has a plurality of opposed holes 636, 637 located at opposite ends 701, 702 respectively. Lock bar members 633, 634, are generally "L-shaped" and are coupled to cam 632 at respective ends 638, 639. Particularly, lock bar 633 has a first planar portion 703 and has a hole 706 located at a first end 638 and which has a second portion 708 which orthogonally projects from portion 703 and which is generally forms an "L-shape" with portion 703 and has a second end 711. Similarly, lock bar 634 has a first planar portion 704 and has a hole 707 located at a first end 639, and which has a second portion 709 which orthogonally projects from portion 704 and which is generally forms an "L-shape" with portion 704 and has a second end 712. Lock bar guides 633, 634 are coupled at respective holes 708, 707 to cam portion 632 at respective holes 636, 637, and this coupling may be made by rivets, by a welded connection, or substantially any other type of connection strategy. Yet further, the cam portion 632 is coupled to locking mechanism 629 by coupling portion 713 through aperture 635, and this coupling may be made by bolts, rivets, or any other type of connection strategy. Thus, lock bar members 633, 634 are coupled to locking mechanism 629 by coupling respective ends 638, 639 to respective ends 701, 702 of cam 632 and further coupling cam 632 to locking mechanism 629 to form a locking assembly 605 which may be utilized for selectively latching and unlatching side cabinet assembly 500, which will be described below.

As is best shown in FIG. 21, the side cabinet assembly 500 further includes a door trim portion 667 which is coupled to surface 622 of portion 619 and which has a width 668 which is, in one non-limiting embodiment, at least the width 621 of portion 619 and which has a plurality of preformed and equally spaced apertures, such as aperture 669, which are linearly coextensive with height 616 of door 620 and which is on axis 670 which is the aligned with axis 671 (i.e., axis 670 is on the same axis as axis 671) of aperture 664. The door trim 667 may be constructed from plastic or some other type of composite material and is fastened to a door by the use of glue. Further, it should be appreciated that the trim portion 667 reflects light rays, such as light ray 680, which may impinge upon it, thereby creating an aesthetically pleasing overall appearance, especially when one views the front of the side cabinet assembly 500 (i.e., the term "front" means the portion of the side cabinet assembly 500 upon which the trim 667 is deployed).

As is best shown in FIGS. 14, 21, 22, side cabinet assembly 500 further includes, in one non-limiting embodiment, substantially the same handle portion 285 and portion 285 may be adapted to be used on side cabinet assembly 500 and which may be selectively attached to the door assembly 590, by the use of, in one non-limiting embodiment, bolts, such as bolt 673, to allow a user to access cavity 800 of side cabinet assembly 500 by (i.e., in order to allow the side cabinet assembly 500 to be efficiently opened). Particularly, handle portion 285 is coupled to door assembly 590 by aligning pre-formed line or axis 672 of apertures 286 of door handle portion 285 with axis 670 of door trim 667 and further aligning axis 672 with pre-formed line or axis 671 of door panel 610 and coupling door handle assembly 295 to door assembly 590 by sliding bolt 673 through respective plurality of holes 286, 669, 664 of respective portions 285, 667, and 619. Further, handle 285 has a first generally "U-shaped" portion 288 and further includes an interior portion of the "U-shape" 289 being directed towards the key receptacle portion 630. It should be appreciated that the interior portion 289 is a convenient place for a user to grasp the side cabinet assembly 500 in order to selectively open side cabinet assembly 500 from a first closed position to an extended position and back to the closed position. Further, in the most preferred, although non-limiting, embodiment of the invention, the handle 285 includes a projecting portion 287 which integrally terminates into the "U-shaped" portion 286 and which abuts and is connected to the edge 663 of door 610 of door assembly 590. Such connection may be made by the use of a conventional fastener or a fastener adhesive or some other type of conventional fastener strategy or methodology.

Figure 26:
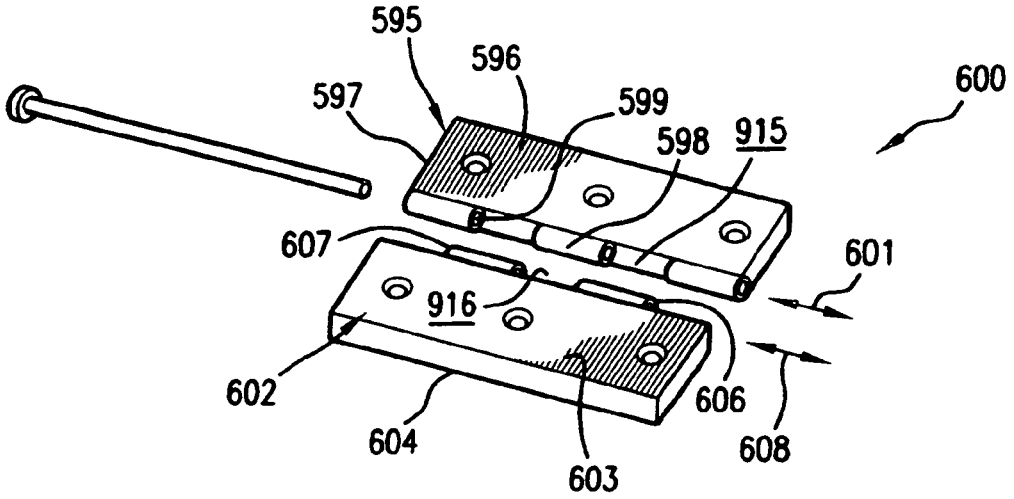
FIG. 26 is a perspective view of a hinge assembly of the side cabinet assembly which is shown in FIG. 16.

Yet further, and is best seen in FIGS. 16 and 26, side cabinet assembly 500 includes a hinge assembly 600 which is coupled to and selectively pivots door assembly 590 from first closed position to a second open position and back to a first closed position, and which is substantially the same as hinge assembly 240 of hutch assembly 100. Particularly, hinge assembly 600 has a first generally planar portion 595 which has a first surface 596 and a second opposed surface 597 and which terminates into a plurality of substantially similar and equally spaced circular or "cylindrical" shaped teeth 598 and which enclose a plurality of apertures, such as aperture 599, and which are aligned along a preformed axis 601. Portion 595 aloe has a plurality of substantially similar and equally spaced grooves 915 which occupies the cavity between two corresponding teeth 598. Hinge assembly 600 also has a second generally planar portion 602 which has a first surface 603 and a second opposed surface 604 and which terminates into a plurality of substantially similar and equally spaced circular teeth 606 which enclose a plurality of apertures, such as aperture 607, which are aligned along an axis 608. Portion 602 also has a plurality of substantially similar and equally spaced grooves 916 which occupy the cavity between two corresponding teeth 606. Portion 595 is coupled to portion 602 by aligning axes 601, 608 and coupling portion 595, 602 to each other by aligning tooth 598 with a respective groove 916 and also aligning tooth 606 with a corresponding groove 915 and inserting pin 609 the respective cavities 599, 607 of teeth 598, 606 respectively. Further, Door assembly 590 is coupled to body 510 by coupling respective surfaces 596, 603 to respective panel members 610, 560 thereby allowing door assembly 590 to pivot along preformed axes 601, 608 of hinge assembly 600 as hinge assembly 590 pivots along axis 608, thus providing a user to access cavity 800 of side cabinet assembly 500. Door assembly 590, in another non-limiting embodiment, may be utilized Yet further, and seen in FIGS. 16, 21, and 24, door assembly 590 has a trim portion 880, which in one non-limiting embodiment is substantially the same as trim portion 685, and which is selectively coupled to planar surface 617 of side cabinet door 610 by the use of conventional fasteners, by adhesive, or by substantially any other desired connection methodology or strategy and which enhances the overall aesthetic appearance of the side cabinet assembly 500. In one non-limiting embodiment, the trim portion 880 is linearly coextensive along length 616 (see FIG. 21) of door assembly 590 and attached to surface 617 along edge 662 of door assembly 590. The member 685 may be constructed from plastic or some other type of composite material and provides an overall aesthetically pleasing view for the side cabinet assembly 500.

Further, as is shown perhaps best in FIGS. 16, 18, and 19, the side cabinet assembly 500 includes a plurality of substantially identical rails, such as rails 805, 806 and each of these substantially identical rails, such as rails 805, 806, are respectively deployed upon one of the respective side surfaces 807, 808 of the respective panels 560, 570. That is, each of the respective rails, such as rails 805, 806 are attached to respective panels 560, 570 along a unique one of the respectively pre-formed line or axis, such as rail line 809 and are attached to a panel by the use of a bolt, rivet or other fastener which is through the apertures, such as aperture 901, which cooperatively form the line upon which the rail member resides.

Particularly, each of the substantially identical rails, such as rails 805, 806, respectively lies upon a unique axis or line, such as axes 809, 810, which are each parallel to the top surface member or portion 520 and which includes a first receptacle portion 811 which is coupled to the respective surfaces 807, 808 and a respective second portion 812 which movably resides within the respective first receptacle portion 811 and which is coupled to a shelf, such as shelf 815 or a drawer, such as drawer 835 (e.g., to a unique side surface of a unique shelf, such as side surface 818 of shelf 817 or to a unique side surface of a unique shelf, such as side surface 836 of drawer 835). Particularly, the second portion 812 moves within (e.g., by the use of ball bearings or some other type of component to facilitate movement) the first portion 811 in a direction which is constrained to only occur along the respective axis formed by the apertures which allow the rail to be attached to the panel, such as panels 560, 570 to which it is attached. In this manner, each second portion 812 is constrained to only move in a direction towards and away from the cavity 800.

In the preferred embodiment of the invention, each rail, such as rails 805, 806, which is placed upon surface 807 of panel 560 (see FIG. 16) has a corresponding rail which is placed upon the surfaces 818, 819 of respective shelves 817, 815 (FIG. 16). The term "corresponding rails", in this context, means that the two "corresponding rails" are linearly coextensive, substantially identical, and reside within the same plane which is parallel to the top surface 520. Similarly, each rail, such as rail 805, which resides upon surface 807 of the panel 560 has a corresponding rail which is resident upon the surface 818 of the drawer 817. Further, each rail, such as rail 806, which resides upon the surface 808 of panel 570 has a corresponding rail which resides upon surface 819 of shelf 815. The use of such rails in combination with utilized shelves will now be discussed. It should be appreciated that the use of such rails with the utilized drawers is substantially the same. It should be realized that in another non-limiting embodiment of the invention, each first portion 811 may also be movably coupled or movably reside within side cabinet 500 and constrained to move towards and away from the cavity 800. In this non-limiting embodiment, each first portion 811 resides within a track which is fixed to a side surface of a panel and which movably but securely contains the first portion.

Figure 29:
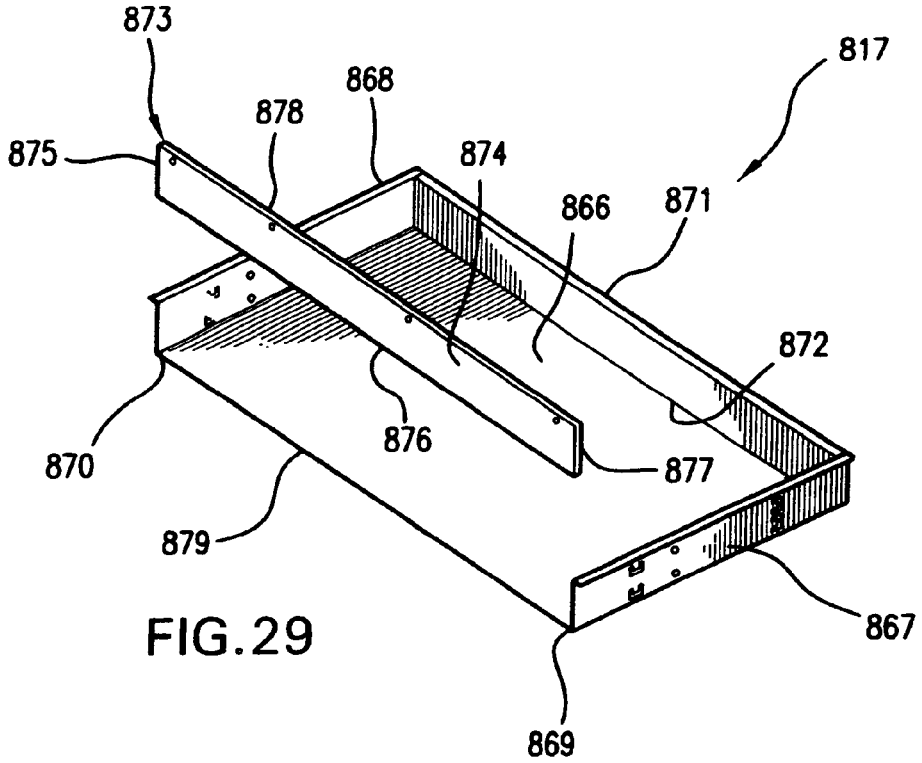
FIG. 29 is a perspective unassembled view of a shelf assembly of the side cabinet assembly which is shown in FIG. 16.

As is perhaps best shown in FIG. 16, the side cabinet assembly 100 includes a plurality of shelves, such as shelves 815, 817, and a plurality of drawers, such as drawer 835. Each shelf 817, 817 respectively includes opposed side surfaces 819. 821 upon which a respective second rail portion 812 is operatively deployed. In this manner, each such shelf, such as shelves 815, 817, is movable from a respective first position, shown by shelf 815 in FIG. 29, in which the shelf is extended from the cavity 800 of the side cabinet assembly 500 (e.g., by having the attached second rail portions 812 move in a direction away from the formed cavity 800), to a second position, shown by shelf 830 of FIG. 16, in which the side portions of the shelf wholly reside within the cavity 800 (e.g., by having the attached second rail portions 812 move back into the cavity 800). It should be appreciated that only when a shelf is extended from the cavity 800 may the contents of the extended shelf be accessed by a user of the side cabinet assembly 500. It should further be appreciated that, in the most preferred, although non-limiting embodiment of this invention, the shelves 815, 817 may be interchanged (e.g., the second portions 812 of the shelf 815 may be placed upon the rail portions 811 which the second portions 812 of the shelf 817 resided upon, as shown in FIG. 16, and the second portions 812 of the shelf 817 may be placed upon the rail portions 811 which the second portions 812 of shelf 815 resided upon as shown in FIG. 29).

Figure 28:
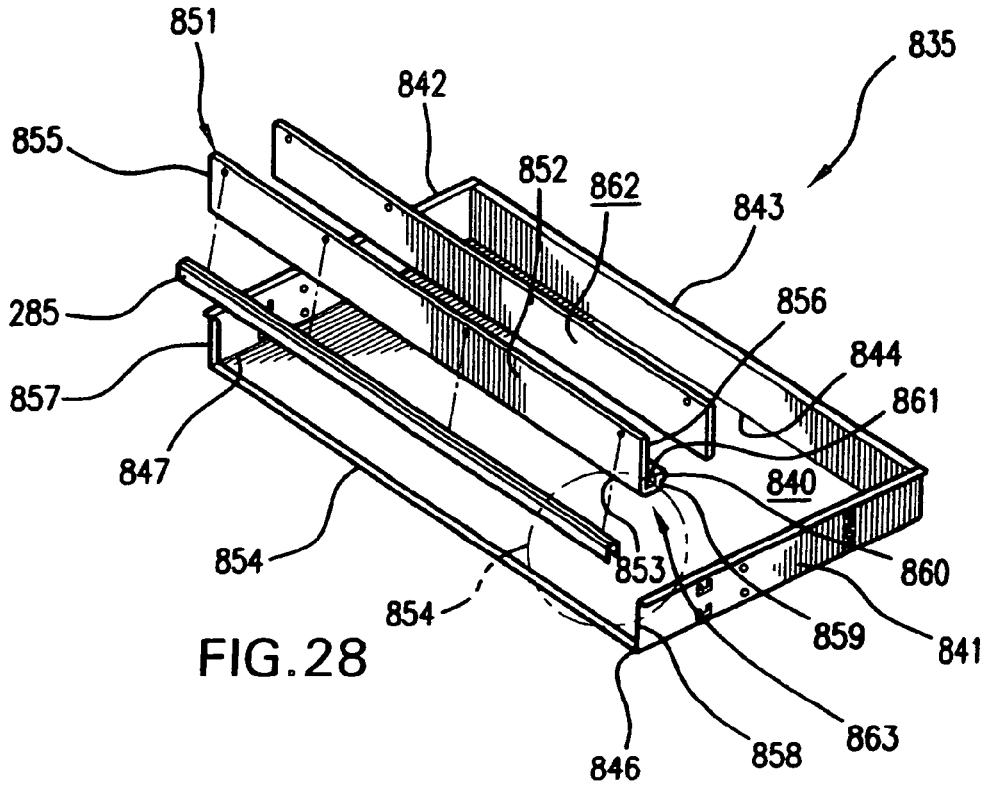
FIG. 28 is a perspective unassembled view of a drawer assembly of the side cabinet assembly which is shown in FIG. 16.

As is perhaps best shown in FIGS. 16 and 28, some or all of the utilized drawers, such a drawer 835, includes a substantially planar bottom shelf portion or member 840 which supports the stored items, substantially identical and generally planar side members 841, 842 which are orthogonally and respectively coupled along opposed edges 846, 847 to the member 840 (i.e., member 840 forms a respective right angle with respect to each member 841, 842), and a generally planar back member 843 which is orthogonally coupled to the bottom member 840 along edge 844 (i.e., member 840 forms right angle with respect to member 843). Such coupling may be achieved by adhesive or by the use of a welded connection or by some other connection methodology or strategy.

In the most preferred, although non-limiting, embodiment of the invention and as beet shown in FIG. 28, some or all of the drawers, such as drawer 835, includes a front member 851 which has the generally planar surface 852 to which the handle portion 285 is attached. Further, the member 851 has an edge 853 which is attached to the edge 854 of the surface of member 840 and which has edges 855, 856 which are respectively attached to edges 857, 858 and which allows the member 851 to cooperate with the members 841, 842, 840, and 843 to form a containment cavity. Further the member 851 includes a lip portion 863 which includes a generally "S-shaped" portion 859. Particularly, portion 859 has ledge 860 which receives and is coupled to the member 840 when the member 851 is coupled to the members 841, 842. The portion 859 further includes a trough 861. Some or all of the drawers, such as drawer 835, further includes a generally planar member 862 which is received into or which overlays the trough 861 and which is attached to the member 851 by the use of fasteners, a welded connection, or any other type of connection strategy. In this manner, some or all of the drawers, such as drawer 835 therefore have a double wall construction (i.e., formed by members 862 and 851) without the use of exposed spot welds. Such a double wall construction makes for a relatively strong drawer which protects against puncturing or structural damage.

In the most preferred, although non-limiting embodiment of the invention, each of the drawers, such as drawers 835, 865 includes door handle portion 285 which was described in a previous embodiment and was seen in FIG. 16. The handle portion 285 may be constructed from plastic or some other type of composite material and is fastened to the door by the use of two substantially identical mounting screws 310, 321 (See FIG. 13) which have their respective heads 322, 323 located hidden from view and located within the drawer.

In the most preferred, although non-limiting, embodiment of the invention and as best shown in FIG. 29, some or all of the shelves, such as shelf 817, includes a substantially planar bottom shelf portion or member 866 which supports the stored items, substantially identical and generally planar side members 867, 868 which are orthogonally and respectively coupled along opposed edges 869, 870 to the member 866 (i.e., member 866 forms a respective right angle with respect to each member 867, 868), and a generally planar back member 871 which is orthogonally coupled to the bottom member 866 along edge 872 (i.e., member 866 forms right angle with respect to member 871). Such coupling may be achieved by adhesive or by the use of a welded connection or by some other connection methodology or strategy.

In the most preferred, although non-limiting, embodiment of the invention and as best shown in FIG. 29, some or all of the shelves, such as shelf 817, includes a front member 873 which has the generally planar surface 874. Further, the member 873 has edges 875, 876, 877, 878 which are respectively coupled to the edges 870, 879, 869, and 872 and which allows the member 873 to cooperate with the members 868, 871, 867, and 866 to form a containment cavity, and which is attached to the member 873 by the use of a welded connection, or any other type of connection strategy.

In operation, and as best seen in FIGS. 16, 23-26, when it is desired to unlock the side cabinet assembly 500 (i.e., to allow the movement of the drawers in the outward or extended direction away from cavity 800), the lock 629 is turned in a counter clockwise direction which causes portion 713 to turn cam 632 in a counter clockwise direction. The cam 632, by being turned, causes lock bar members 633, 634, which are coupled to cam 632, to similarly turn in a clockwise direction, and causes the respective ends 711, 712, of lock bar members 633, 634 to be drawn in towards axis 850 (i.e., member 633 is moved in direction 905 towards axis 605 while member 634 is moved in direction 900 towards axis 605). This causes the respective lock bar guides 633, 634 to be removed from within respective slots 540, 587 of respective panel members 520, 580, and thereby allow door assembly 590 to be freely moved along axes 601, 608 of hinge assembly 600, and which allows cavity 800 of side cabinet assembly 500 to be accesses.

When it is desired to lock the side cabinet assembly 500, the lock portion 629 is selectively turned in a clockwise manner which causes the portion to tarn cam 632 in a clockwise manner. The rotating of cam member 632 causes lock bar members 633, 634 to be pushed away from axis 850 (i.e., member 633 is moved in direction 905 away from axis 606 while member 634 is moved in direction 905 away from axis 605). This causes the respective lock bar guides 633, 634 to reside within respective slots 540, 587 of respective panels 520, 580, thereby causing guide members 633, 634 to engage latches 532, 533 and be placed in a latched condition.

It is to be understood that the present inventions are not limited to the exact construction or embodiment which has been delineated above, but that various changes and modifications may be made without departing from the spirit and the scope of the inventions as they are more fully delineated in the following claims.

What is claimed is:

1. A hutch assembly comprising a bottom panel assembly including a bottom member; a bottom support member having a pair of opposed planar surfaces and having a plurality of apertures which cooperatively allow said bottom support member to be selectively coupled to said bottom member and to a surface of a toolbox wherein a first one of said pair of said opposed planar surfaces selectively engages said toolbox and wherein a second one of said pair of said opposed planar surfaces selectively engages said bottom member, thereby selectively coupling said bottom member to said toolbox, and wherein said hutch assembly further includes a panel which resides between said bottom member and said bottom support member and which is coupled to each of said bottom member and said bottom support member; a plurality of panels which are coupled to said bottom support member and which cooperatively form a cavity; a USB receptacle; a generally round cigarette lighter receptacle; a rectangular power strip; a switch; a shelf which is disposed within said cavity and which is coupled to at least two of said plurality of said panels, wherein said shelf has a planar top surface, an opposed and flat bottom surfaces, and a plurality of edge surfaces which are respectively orthogonal to each of said planar top surface and said flat bottom surface, and wherein only a single one of said plurality of edge surfaces includes a plurality of preformed slots and wherein a first of said plurality of slots allows access to said USB receptacle, a second of said plurality of slots allows access to said switch, and a third of said plurality of slots allows access to said power strip and wherein each of said USB receptacle, said switch, and said power strip are wholly, respectively, and completely contained within said shelf and respectively move within said cavity as said shelf is moved within said cavity, and wherein said shelf further includes a fourth round slot which allows access to said cigarette lighter receptacle which is wholly included within said shelf and which resides between two of said plurality of slots and wherein said hutch assembly further includes a plurality of substantially identical track assemblies which are respectively coupled to third and fourth panels of said plurality of panels; a first bearing assembly which is disposed with a first of said plurality of substantially identical track assemblies and a second bearing assembly which is disposed within a second of said plurality of substantially identical track assemblies; and a trolley member which is coupled to said first and second bearing assemblies and which is selectively movable only in a first direction toward said cavity and a second direction away from said cavity and parallel to said shelf, and wherein said hutch assembly further includes a door member which is coupled to said trolley member and wherein the hutch assembly further including at least one drawer which is disposed within said cavity and which is selectively movable from a first retracted position within said cavity to a second extended position out of said cavity, and wherein said at least one drawer includes a front member having a generally planar surface which integrally terminates into a "s" shaped lip which forms a reception trough; a planar member which is received into said trough and which is coupled to said generally planar surface of said front member; and a handle which is coupled to said front member and wherein said shelf further comprises longitudinally opposed and substantially similar edges which are linearly coextensive and which orthogonally projected in a downward direction and wherein each of said edges include a respective pair of substantially similar slots and wherein a first slot of a first of said edges is axially aligned with a first slot of a second of said edges and wherein a second slot of said first of said edges is axially aligned with a second slot of a second of said edge.

* * * * *